US006782814B2

(12) United States Patent
Tokiwa

(10) Patent No.: US 6,782,814 B2
(45) Date of Patent: Aug. 31, 2004

(54) METHOD AND APPARATUS FOR DETECTING REGISTERING ERRORS, AND AUTOMATIC REGISTER CONTROL APPARATUS FOR MULTI-COLOR ROTARY PRESSES

(75) Inventor: Shizurou Tokiwa, Zushi (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/695,855

(22) Filed: Oct. 29, 2003

(65) Prior Publication Data

US 2004/0118311 A1 Jun. 24, 2004

(30) Foreign Application Priority Data

Dec. 10, 2002 (JP) ..... 2002-357514

(51) Int. Cl.[7] ..... B41M 1/14

(52) U.S. Cl. ..... 101/211; 101/181; 101/248; 101/485

(58) Field of Search ..... 101/483–486, 101/181, 211, 248, 286, 171, 178; 226/3; 358/1.1, 1.9

(56) References Cited

U.S. PATENT DOCUMENTS

| | | | | |
|---|---|---|---|---|
| 4,546,700 A | * | 10/1985 | Kishner et al. | 101/211 |
| 5,056,430 A | * | 10/1991 | Bayerlein et al. | 101/211 |
| 5,813,333 A | * | 9/1998 | Ohno | 101/181 |

FOREIGN PATENT DOCUMENTS

| | | |
|---|---|---|
| JP | 58-020457 | 2/1983 |
| JP | 63-22651 | 1/1988 |
| JP | 01-192558 | 8/1989 |
| JP | 01-192559 | 8/1989 |
| JP | 03-011900 | 1/1991 |
| JP | 07-246700 | 9/1995 |
| JP | 07-304162 | 11/1995 |

* cited by examiner

*Primary Examiner*—Minh Chau
(74) *Attorney, Agent, or Firm*—McGlew and Tuttle, P.C.

(57) ABSTRACT

A method for detecting registering errors for multi-color rotary presses in which register marks are printed on a paper web by each printing section, a light source is caused to flash based on a reference signal generated by signal output means operating in synchronism with the rotation of a predetermined plate cylinder for outputting signals, the register marks printed by all printing sections are read as two-dimensional image data via reading means operating in synchronism with the flashing of the light source, the two-dimensional image data are developed into matrix data, a first center of gravity is found as an approximate center of gravity of each register mark from the matrix data, a second center of gravity is found as a high-precision center of gravity of each register mark from the matrix data based on the first center of gravity, the second center of gravity of a predetermined register mark is used as a reference to find the relative positions of other register marks, a deviation of the resulting relative positions from the reference relative position is found, and the deviation is regarded as a registering error.

13 Claims, 11 Drawing Sheets

METHOD AND APPARATUS FOR DETECTING REGISTERING ERRORS, AND AUTOMATIC REGISTER CONTROL APPARATUS FOR MULTI-COLOR ROTARY PRESSES

BACKGROUND OF THE INVENTION

1. Field of the Invention

The present invention relates generally to a method and apparatus for detecting registering errors of register marks printed on a paper web by each printing section to maintain exact agreement in the printing position of each color, and an automatic register control apparatus operating to eliminate detected registering errors, and more specifically to a method and apparatus for detecting registering errors, and an automatic register control apparatus that make it possible to detect the position of register marks more accurately when the shape of printed register marks is deformed.

2. Description of the Related Art

In a multi-color rotary press, if the positions of images of each color printed by each printing section do not agree with each other, no multi-color printed matter having desired color tones can be obtained. Efforts are therefore made in the trade to detect register errors that correspond to color mismatching, and to correct them to reduce registering errors to zero.

The most commonly used registering error detecting methods is such that register marks are printed, together with print images, for each color on a paper web, a register mark is set as a reference, and a deviation of the relative position of the other register marks with respect to the position of the reference register mark is detected as an amount of registering error. A reference line or point is therefore set on each register mark to detect deviations in the relative position.

Among publicly-known methods for setting a reference line or point in each register mark proposed is Japanese Published Unexamined Patent Application No. Sho-58 (1983)-20457, in which a register mark comprising a line segment having a predetermined length is provided for each color on a paper web in parallel with the longitudinal direction (direction of web travel) and at predetermined intervals in the lateral direction (across-the-width direction of web), a longitudinal reference line is set at the tip in the longitudinal direction of each register mark and a lateral reference line is set at the center of the line width of the register mark, and a deviation in relative position between the reference register mark and the other reference marks is found.

Proposed in Japanese Published Unexamined Patent Application No. Hei-1(1989)-192558, is a method for finding a deviation in relative position between a reference register mark and the other register marks by reading cross-shaped register marks printed on a paper web by a color camera, scanning color-separated still images from top to bottom in the longitudinal direction and in the lateral direction, setting the first acquired image position (upper left edge of the vertical line of the cross-shaped register mark) as the lateral reference, and the lateral image position (upper edge of the vertical line of the cross-shaped register mark) acquired as the side edge of the first acquired image (left edge of the vertical line of the register mark) is scanned from top to bottom in the longitudinal direction as the longitudinal reference, and setting the intersection of a line parallel to the longitudinal direction passing the lateral reference and a line parallel to the lateral direction passing the longitudinal reference as the reference point of the register mark.

Furthermore, proposed in Japanese Published Unexamined Patent Application No. Hei-3(1991)-11900 is a method for finding a deviation in relative position between a reference mark and the other reference marks by using register marks of a right-angled triangle shape having sides parallel to the longitudinal and lateral directions, detecting the register marks in the longitudinal direction with a photoelectric sensor, providing a predetermined number of signal pulses output at every rotation of a plate cylinder and a reference pulse output at every rotation of the plate cylinder, setting the side of the register mark parallel to the lateral direction of the register mark as the longitudinal reference line and the hypotenuse of the register mark as the lateral reference line, detecting the number of signal pulses output in a lapse of time from the generation of the reference pulse till the photoelectric sensor detects the longitudinal and lateral reference lines, and finding a deviation of the number of the detected signal pulses from a predetermined number of reference pulses and converting the deviation into a distance.

All of these prior-art methods involve the detection of the outer edge of an image of a printed register mark as a reference line or point in both the longitudinal and lateral directions or either thereof.

Images of printed register marks, however, tend to involve blurs on the outer edges due to the adverse effects of secular changes in ink viscosity, change in the surface quality of paper, and secular changes in the balance between ink and dampening water particularly in offset printing, and the amount of blurs tends to change over time and by location. The longitudinal reference line in Reference 1, the reference point in Reference 2, and the longitudinal and lateral reference lines in Reference 3 have therefore had the difficulty in detecting correct deviations due to the negative effects of blurs.

To cope with this, methods for setting reference points free from the negative effects of blurs have been proposed and publicly known, for example, in Japanese Published Unexamined Patent Application Nos. Sho-63(1988)-2265 1, Hei- 1(1989)-192559, Hei-7(1995)-246700 and Hei-7 (1995)-304162.

Proposed in Japanese Published Unexamined Patent Application No. Sho-63(1988)-22651 is a method for eliminating the negative effects of blurs by scanning register marks of a 45-degree inclined square shape in the lateral direction with a line sensor, finding the central coordinate values of a plurality of the acquired line segments crossing the register marks, regarding the average value of the central coordinate values as the lateral central coordinate value of the register mark, applying to it a geometrical figure rule that, in a 45-degree inclined square, the distance from a point on the straight line joining the vertices to the hypotenuse is equal to the distance up to the vertex closer to it to find the closer longitudinal vertex position based on the lateral central position, determining two longitudinal vertices by carrying out the above procedure at multiple location, regarding the midpoint of the vertices as the center of the register mark, and setting the midpoint as a reference point.

Also proposed in Japanese Published Unexamined Patent Application No. Hei-1(1989)-192559 is a method for eliminating the negative effects of blurs by using cross-shaped register marks, parallel-scanning the pixel matrix of the still images of the register marks in longitudinal and lateral directions, adding up the number of pixels appearing at each scanning position in both directions, regarding the intersection of a scanning line having the largest number of pixels as the center of the cross-shaped register mark, and setting it as a reference point.

In addition, Japanese Published Unexamined Patent Application No. Hei-7(1995)-246700 proposes a method for eliminating the negative effects of blurs by scanning circular register marks at predetermined intervals in the longitudinal direction and in the lateral direction at two locations on both sides of the diameter with a line sensor, regarding the central coordinate value of the line data of the scanning line crossing the register mark as the lateral center coordinate value of the circular register mark, calculating the longitudinal coordinate value of the circle center from the lengths of the two scanning line data using the Pythagorean theorem, finding the central point coordinate value of the circle from the longitudinal coordinate value of the circle center and the lateral center coordinate value found earlier, and regarding it as a reference point.

Furthermore, Japanese Published Unexamined Patent Application No. Hei-7(1995)-304162 proposes a method for eliminating the negative effects of blurs by scanning register marks of a right-angled isosceles triangle shape with the hypotenuse oriented in the longitudinal direction at two longitudinal locations at predetermined intervals so as to cross the different sides containing the right angle in lateral direction with a photoelectric sensor, calculating the hypotenuse length and the right-angle vertex position of the right-angled isosceles triangle by applying a geometrical figure rule that, in a right-angled isosceles triangle with the hypotenuse oriented in the longitudinal direction, the length of the lateral scanning line from a point of the hypotenuse is equal to the distance from the point to a longitudinally closer vertex, finding the calculation results the center of gravity coordinate value of the right-angled isosceles triangle, and regarding it as a reference point.

These proposals for eliminating the negative effects of blurs are intended to improve the accuracy of detection of registering errors by calculating a center or center of gravity of a register mark using geometrical figure rules based on the positional information obtained from the outer edge of the printed register mark that contains blurs, and setting the center or center of gravity as a reference point. The calculation method using geometrical figure rules, however, cannot calculate a correct reference point when a deformation of the register mark changes similarly with respect to the reference point, that is, unless blurs remain uniform over the entire outer edge of the register mark.

In actual printing operation, however, an image of a printed register mark tends to be subtly changed due to secular changes in ink viscosity, changes in the surface quality of paper, and the effects of dampening water in offset printing. In offset printing, a deteriorated balance between ink and dampening water may cause contamination on non-image areas, slurs of images, local blurs, missing images and blurs. Thus, deformation of a register mark tends to become uneven over the entire surface. In such a case, automatic register control may result in aggravated registering errors, increasing waste printing.

There has been a strong need among printing machine users for achieving close registration as quickly as possible to minimize waste printing at the start of printing. Because of the difficulty in accomplishing good quality printed matter until the supply of ink and dampening water is stabilized at the start of printing, however, it has been often the case that automatic register control has been left inoperative for a given time after the start of printing. As a result, even when all other printing conditions have got ready for operation, printing registration has not been able to be accomplished for a predetermined time after the start of printing due to suspended automatic register control. This has resulted in the discarding of waste printed matter that had otherwise been shipped as normal printed matter, contrary to printing machine users.

The present invention seeks to overcome these problems by improving the accuracy with which the reference position of deformed register marks is detected, thereby reducing waste printing in unstable printing conditions, particularly at the start of printing.

SUMMARY OF THE INVENTION

It is an object of the present invention to provide a method for detecting registering errors in multi-color rotary presses that can improve the accuracy with which the reference position of deformed printed register marks is detected.

It is another object of the present invention to provide a method for finding a first center of gravity that is an approximate center of gravity.

It is still another object of the present invention to provided a method for finding a first center of gravity that is an approximate center of gravity from the read matrix data of register marks of a single and point-symmetrical figure.

It is a further object of the present invention to provide a method for finding a first center of gravity that is an approximate center of gravity from the read matrix data of register marks of a single and point-symmetrical figure, and finding a second center of gravity that is a high-precision center of gravity from the first center of gravity.

It is a still further object of the present invention to provide an apparatus for detecting registering errors in multi-color rotary presses that can improve the accuracy with which the reference position of deformed printed register marks is detected.

It is a still further object of the present invention to provide an automatic register control apparatus in multi-color rotary presses that can improve the accuracy with which the reference position of deformed printed register marks is detected.

In the embodiments disclosed in the present invention, a method for detecting registering errors in multi-color rotary presses comprising the steps of printing more than one register mark by each printing section on a paper web, causing a light source to flash based on a reference signal output by signal output means that operates in synchronism with the rotation of a predetermined reference plate cylinder and outputs signals, reading the register marks printed by all the printing sections by reading means that operates in synchronism with the flashing of the light source, developing the read register marks into matrix data, finding a first center of gravity that is an approximate center of gravity of each register mark, further finding a second center of gravity that is a high-precision center of gravity of each register mark from the matrix data based on the first center of gravity, using the second center of gravity of a predetermined register mark and finding the relative positions of the second center of gravity of the other register marks, finding a deviation of the found relative positions from the predetermined reference relative position and regarding the deviation as a register error.

DETAILED DESCRIPTION OF THE PREFERRED EMBODIMENTS

Now, embodiments of the present invention will be described, referring to the accompanying drawings.

Figure 1:
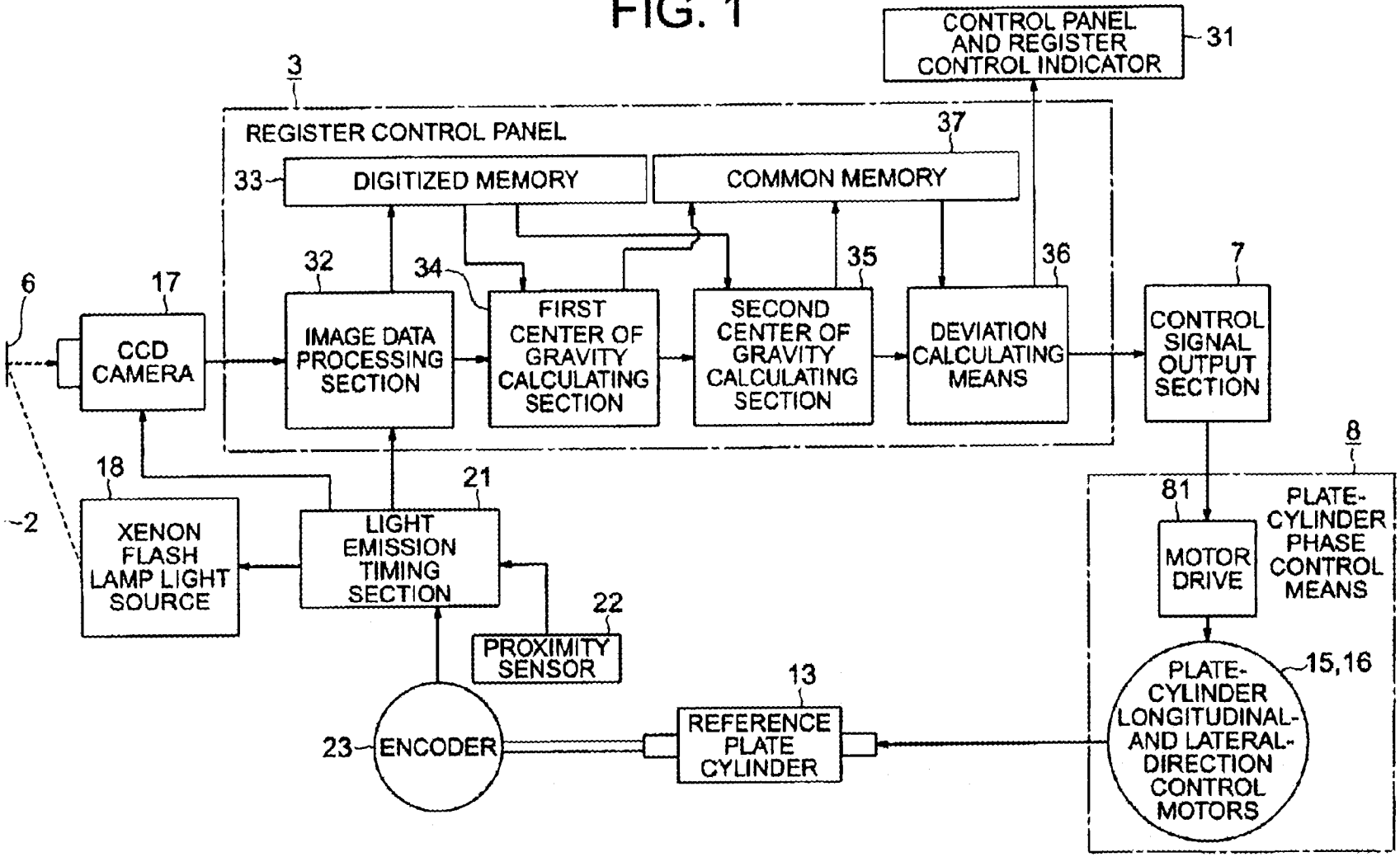
FIG. 1 is a block diagram showing an automatic register control apparatus embodying the present invention.
Figure 2:
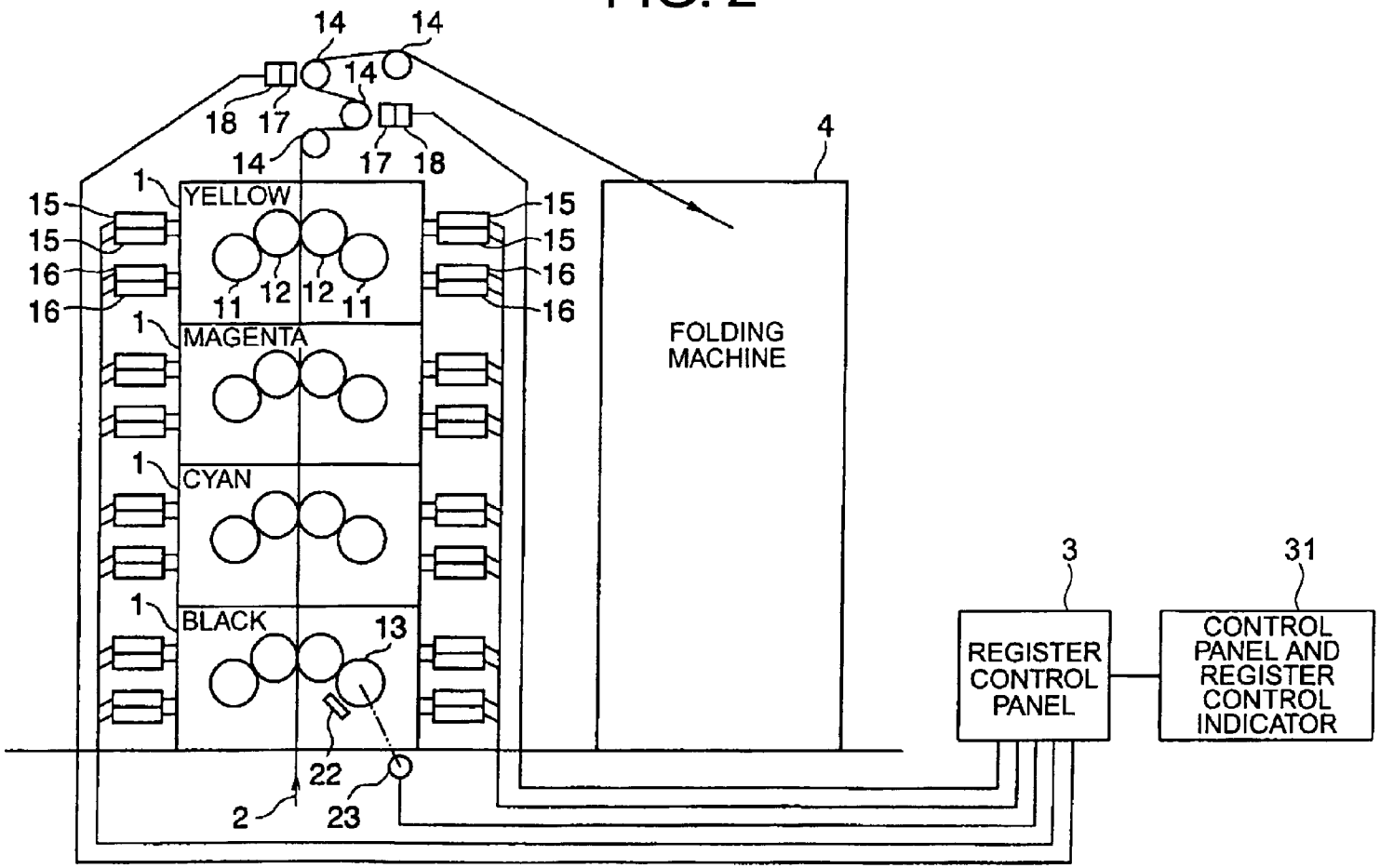
FIG. 2 is a schematic diagram of a multi-color rotary press to which the automatic register control apparatus according to the present invention is applied.

FIG. 1 is a block diagram showing an automatic register control apparatus embodying the present invention. FIG. 2 is a schematic diagram of a multi-color rotary press to which the automatic register control apparatus according to the present invention is applied.

In FIGS. 1 and 2, reference numeral 1 to a printing unit, 2 to a paper web, 3 to a register control panel, 4 to a folding machine, 6 to a register mark, 7 to a control signal output section, 8 to plate cylinder phase control means, 11 to a plate cylinder, 12 to a blanket cylinder, 13 to a reference plate cylinder, 14 to a guide roller, 15 to a longitudinal direction control motor, 16 to a lateral direction control motor, 17 to a CCD camera, 18 to a xenon flash lamp light source, 21 to a light emission timing section, 22 to a proximity sensor, 23 to an encoder, 31 to a control panel/register control indicator, 32 to an image data processing section, 33 to a digitized memory, 34 to a first center of gravity calculating section, 35 to a second center of gravity calculating section, 36 to deviation calculating means, 37 to a common memory, and 81 to a motor drive, respectively.

In the multi-color rotary press embodying the present invention which will be described in the following, BB-type (blanket-to-blanket type) printing units (printing sections) 1 are stacked in the order of black (BK), cyan (C), magenta (M), and yellow (Y) from bottom to top to overprint four colors for multi-color printing.

Each printing unit 1 has a plate cylinder and a blanket cylinder 12, and sequentially prints images of black, cyan, magenta, yellow, and register marks 6 (refer to FIGS. 3 and 5) for registering the printed images on both sides of a paper web 2 travelling from bottom to top.

In this embodiment, the right-hand plate cylinder for black shown in FIG. 2 is regarded as a reference plate cylinder 13, and an encoder 23 is provided as signal output means that operates in synchronism with the reference plate cylinder 13. In the vicinity of the reference plate cylinder 13 provided is a proximity sensor 22 as a sensor for detecting a rotating reference position on the reference plate cylinder 13 as it approaches the sensor 22 and outputting a reference position signs The paper web 2 passes through a pair of blanket cylinders 12 and 12 each of four colors, is fed to a folding machine 4 via a guide roller 14 where the paper web 2 is cut to an appropriate length and folded.

In the vicinity of the guide roller 14 disposed are a CCD camera 17 that is reading means for reading the register marks 6, and a xenon flash lamp light source 18 for illuminating the register marks 6. The encoder 23 that operates in synchronism with the rotation of the reference plate cylinder 13 outputs a predetermined number of reference pulses (reference signals) per rotation of the reference plate cylinder 13. The light emission timing section 21 outputs a light emission timing signal as the light emission timing section 21 counts up a predetermined number of reference pulses. Upon receipt of the light emission timing signal, the xenon flash lamp light source 18 emits light, and the CCD camera 17 reads as still images the register marks that pass before the camera. All these operations will be described in more detail later.

The read still images are input in the register control panel 3, the position of each register mark 6 is calculated by the image data processing section 32, the first center of gravity calculating section 34 and the second center of gravity calculating section 35 housed in the register control panel 3, and a deviation value of the calculated relative positions of the other register marks 6 with respect to the reference register mark 6 among the register marks 6 of four colors from the preset reference relative position is calculated by deviation calculating means 36. The calculation results are displayed in the control panel and the register control indicator 31, and converted into a control signal by the control signal output section 7 for input into the motor drive 81 of the plate cylinder phase control means 8. A motor 15 for controlling the longitudinal direction (direction of web travel) of the plate cylinder 11 of each printing unit 1, and a motor for controlling the lateral direction (across-the-width direction of web) of the plate cylinder 11 are operated in accordance with the control signal to perform register correction so as to reduce the deviation to zero. These calculating operations and data flow will be described in more detail later.

Figure 3:
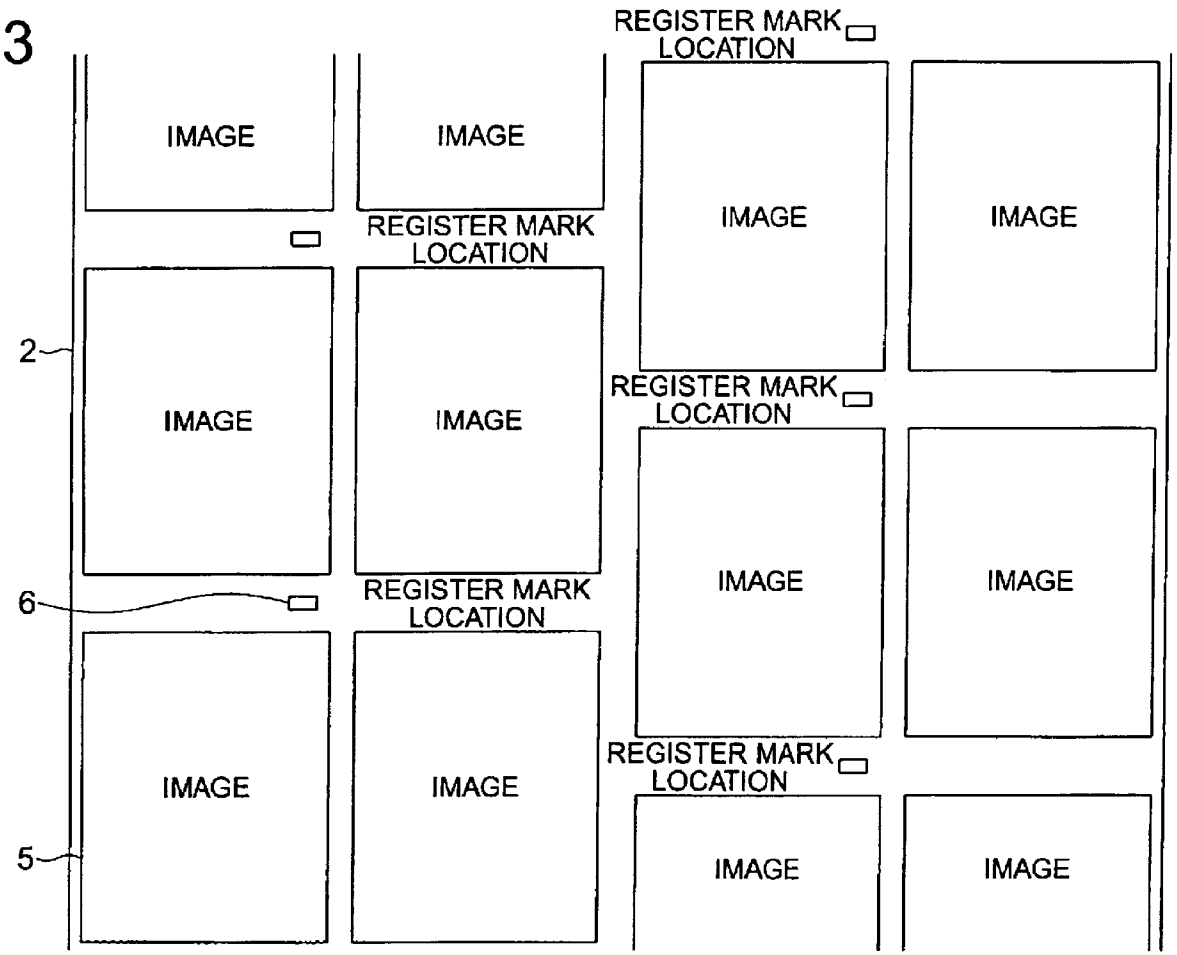
FIG. 3 is a diagram of assistance in explaining the layout of images and register marks printed on a paper web.

FIG. 3 is a diagram showing the layout of images and register marks printed on the paper web.

The register marks 6 on the paper web 2, grouped into a set comprising those for four colors arranged in a frame shown in the figure, are disposed at more than one location per edition. The location of the register marks is not limited to that shown in FIG. 3, but may be anywhere in the non-image areas having no images.

Figure 4:
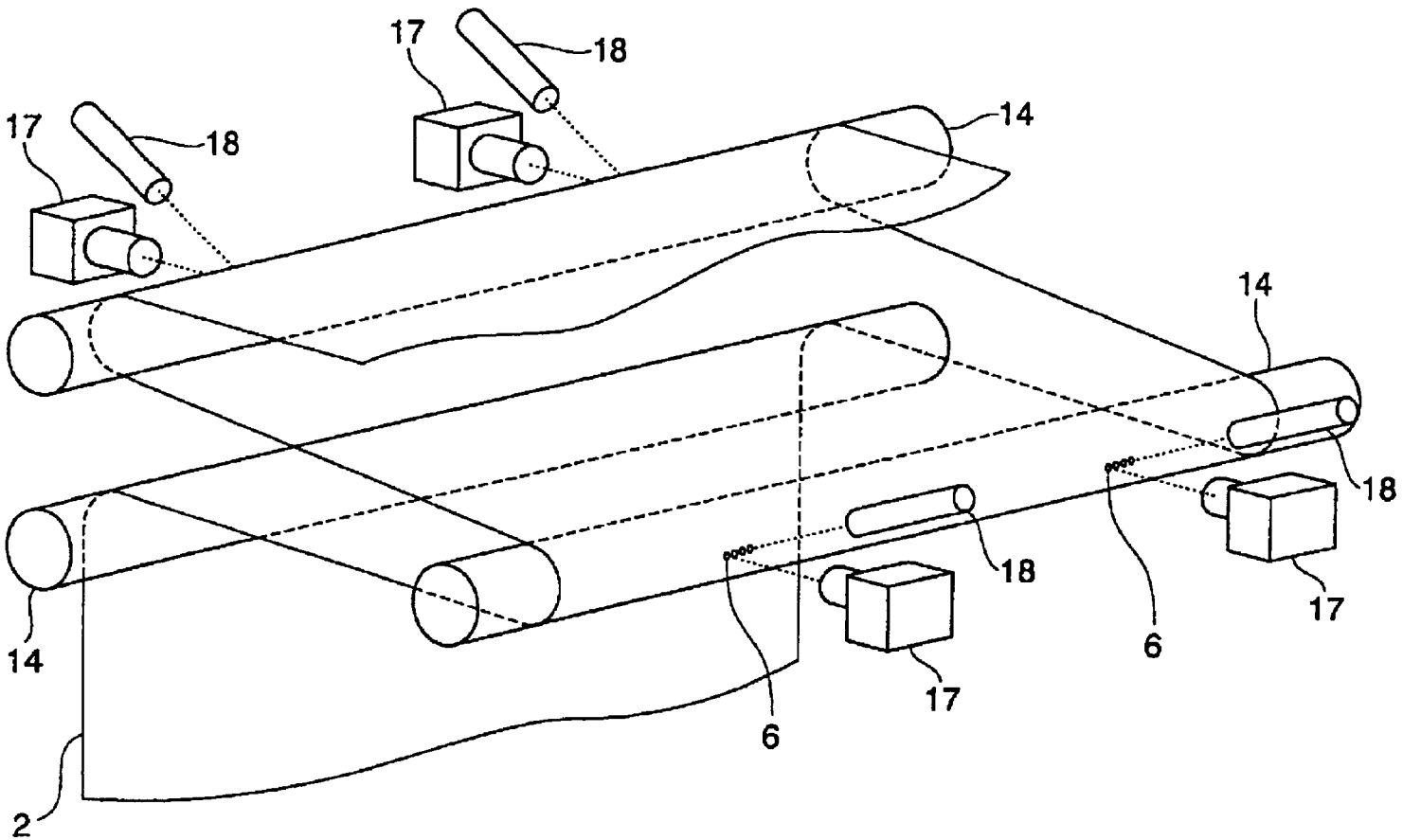
FIG. 4 is a perspective view showing the layout of reading means for reading register marks and light sources.

FIG. 4 is a perspective view showing the layout of the reading means for reading register marks and light sources according to the present invention. The figure shows the relative position of the CCD cameras 17 for reading the register marks 6 in the neighborhood of the guide roller 14, and the xenon flash lamp light source 18. Their locations and the number of units may be changed appropriately depending on the arrangement and orientation of the register marks 6.

Figure 5:
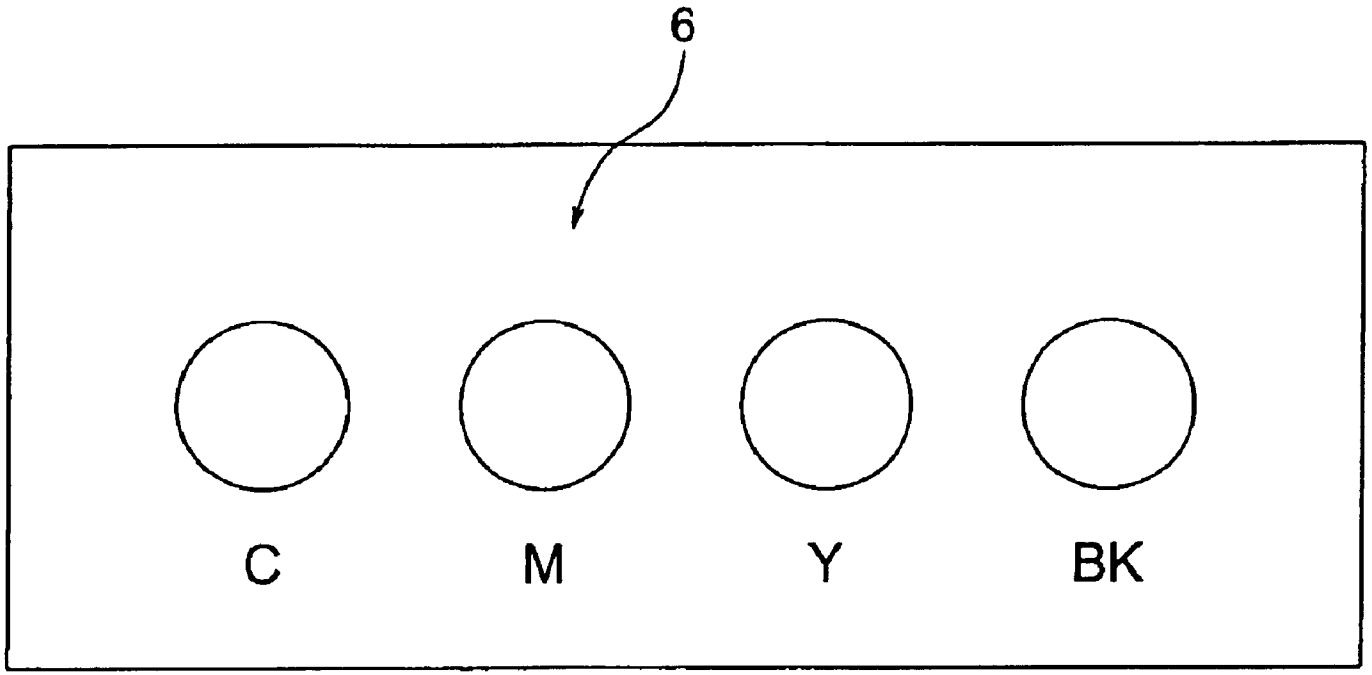
FIG. 5 is a diagram showing an arrangement of register marks.

FIG. 5 is a diagram showing an arrangement of the register marks 6. In this example, a set of register marks 6 of cyan, magenta, yellow and black aligned laterally at equal intervals are printed by each printing unit 1 (frame lines are drawn in FIG. 5 for convenience of explanation with reference to the positional relationship of the register marks 6 shown in FIG. 3, and do not constitute part of the register mark 6). The arrangement of the four-color register marks 6 is not limited to the example shown in the figure, but may be a longitudinal one-row arrangement, a longitudinal or lateral multiple-row arrangement, a staggered arrangement, or uneven-interval arrangement.

The shape of the register mark 6 is also not limited to a circular shape as used in the example. Shape requirements for register marks will be discussed in detail later, in connection with the calculation of center of gravity.

Now, the operation of the present invention will be described in the following, referring to FIGS. 1 and 2.

The proximity sensor 22 detects the reference position set on the reference plate cylinder 13 and outputs a reference position signal to the light emission timing section 21 once per rotation. The encoder 23 of the light emission timing section 21 that operates in synchronism with the reference plate cylinder 13 counts at all times via the internal counter the number of reference pulses that are output in a predetermined number per rotation of the reference plate cylinder 13, and clears the count value to resume counting when a reference position signal is input from the proximity sensor 22. As the count value reaches a predetermined number, the light emission timing section 21 outputs a light emission timing signal, which is then transmit to the CCD camera 17, the xenon flash lamp light source 18, and the image data processing section 32 in the register control panel 3.

A count value setting for generating a light emission timing signal is set at the timing at which the register mark 6 printed on the paper web 2 passes the detecting location of the CGD camera 17. Upon receipt of the light emission timing signal, the xenon flash lamp light sources 18 illuminate the register marks 6, and the CCD cameras 17 open the exposure shutters thereof to take the still images of the register marks 6 as two-dimensional image data on the CCD elements provided therein.

The light emission timing signal is output every time a register mark 6 printed on the web 2 passes the image-taking position of the CCD camera 17, and a still image of the register mark 6 is taken.

The image data processing section 32 which receives the light emission timing signal from the light emission timing section 21, together with the CCD camera 17 and the xenon flash lamp light source 18, reads the still image of the register mark 6 that is developed two-dimensionally on the CCD elements in the CCD camera, converts the still image through A/D conversion processing into two-dimensional developed data of pixels having density gradations, which are then digitized and stored in the digitized memory 33 in the form of a matrix data of digitized pixels. This process will be described in more detail in what follows.

First, the entire region of the CCD elements developed two-dimensionally in the CCD camera 17 is divided in advance into subregions in accordance with the arrangement of the register marks 6. In the example shown in FIG. 5, for example, where four-color register marks 6 are arranged on a lateral straight line, the entire region of the CCD elements is divided laterally into four subregions, and information on the positional relationship among the subregions, such as information on the mutual distances of the reference positions set for the subregions, is imparted to them. The image data processing section 32 processes still-image data for each subregion. The subsequent calculations can therefore be performed for each subregion, that is, for each register mark 6.

In case where the register marks 6 are arranged in a different layout from that shown in FIG. 5, the entire region of the CCD elements is divided into differently divided subregions. If the four-color register marks 6 are arranged at locations corresponding to the four vertices of a rectangle, the entire region of the CCD elements is divided into four subregions; two longitudinal subdivisions and two lateral subdivisions, to impart information on the positional relationship among the subregions to them.

The image data processing section 32 converts, through A/D conversion, the electric charges charged in each CCD element in the CCD camera 17 corresponding to the image of the register mark 6 into digital values having density gradations, which are then developed into an array data of digital values corresponding one-for-one to the array of the CCD elements, that is, matrix data. The image data processing section 32 then sets an appropriate threshold value for each image data of the register mark 6 for each color, converts the digital value data having density gradations into binary data representing one of two possible states; with or without data, and further into matrix data of digitized pixels corresponding one-for-one to the array of the digital value data.

The format of the matrix data is given by the address values representing pixels on an orthogonal coordinate system with the web travel direction (longitudinal direction) as the y-axis, the direction vertical to it as the x-axis, and the longitudinally lowermost and laterally far left end, that is, the left lower corner of the entire region of the matrix data as the point of origin 0. The pixel P located at the m-th in the x-axis direction and at the n-th in the y-axis direction from the origin 0, for example, is defined as P (m, n). In the following, therefore, calculation based on matrix data will be described in terms of pixels using address values.

The image data processing section 32 sequentially stores the matrix data of digitized pixels of each register mark 6 at a predetermined location of the digitized memory 33. Upon completion of storage, the image data processing section 32 outputs a processing end signal to the first center of gravity calculating section 34. The subsequent processing for finding the center of gravity of each register mark 6 is carried out for the matrix data of the register mark 6 of each color.

As a processing end signal is input from the image data processing section 32, the first center of gravity calculating section 34 reads the matrix data of register marks 6 for one color to another from the digitized memory 33 to find a first center of gravity $G_1$ ($x_{g1}$, $y_{g1}$) as an approximate center of gravity of each register mark 6. This calculation process will be described in more detail in the following.

The first center of gravity calculating section 34 has a multi-calculation function housing a plurality of calculation procedures to perform calculations by calling up an appropriate calculation procedure, Since the optimum calculation procedure to find the first center of gravity $G_1$ may change depending on the shape of the printed and read register marks 6, the optimum calculation procedure is selected through program instructions given from the outside.

A plurality of calculation procedures for finding the first center of gravity $G_1$ stored in the first center of gravity calculating section 34 are those to which the geometric figure rule of finding a reference point of a figure from points on the outer edge of the image of a register mark 6, based on the assumption that the shape of the printed register mark 6 is geometrically correct, is applied. Since the first center of gravity calculating section 34 has a multi-calculation function capable of selecting and performing any of a plurality of calculation procedures, any type of calculation procedure can be properly programmed and housed in the first center of gravity calculating section 34 so long as the geometrical figure rule is applied to it.

As an example of the calculation procedure based on the geometrical figure rule performed by the first center of gravity calculating section 34, the calculation procedure ① for point-symmetrical register marks 6 will be described in the following, referring to FIG. 6 where a circular register marks are employed. Needless to say, the calculation procedure can be performed for register marks 6 of any point-symmetrical shape, such as rhombus, square, rectangle and ellipse, in exactly the same manner.

Figure 6:
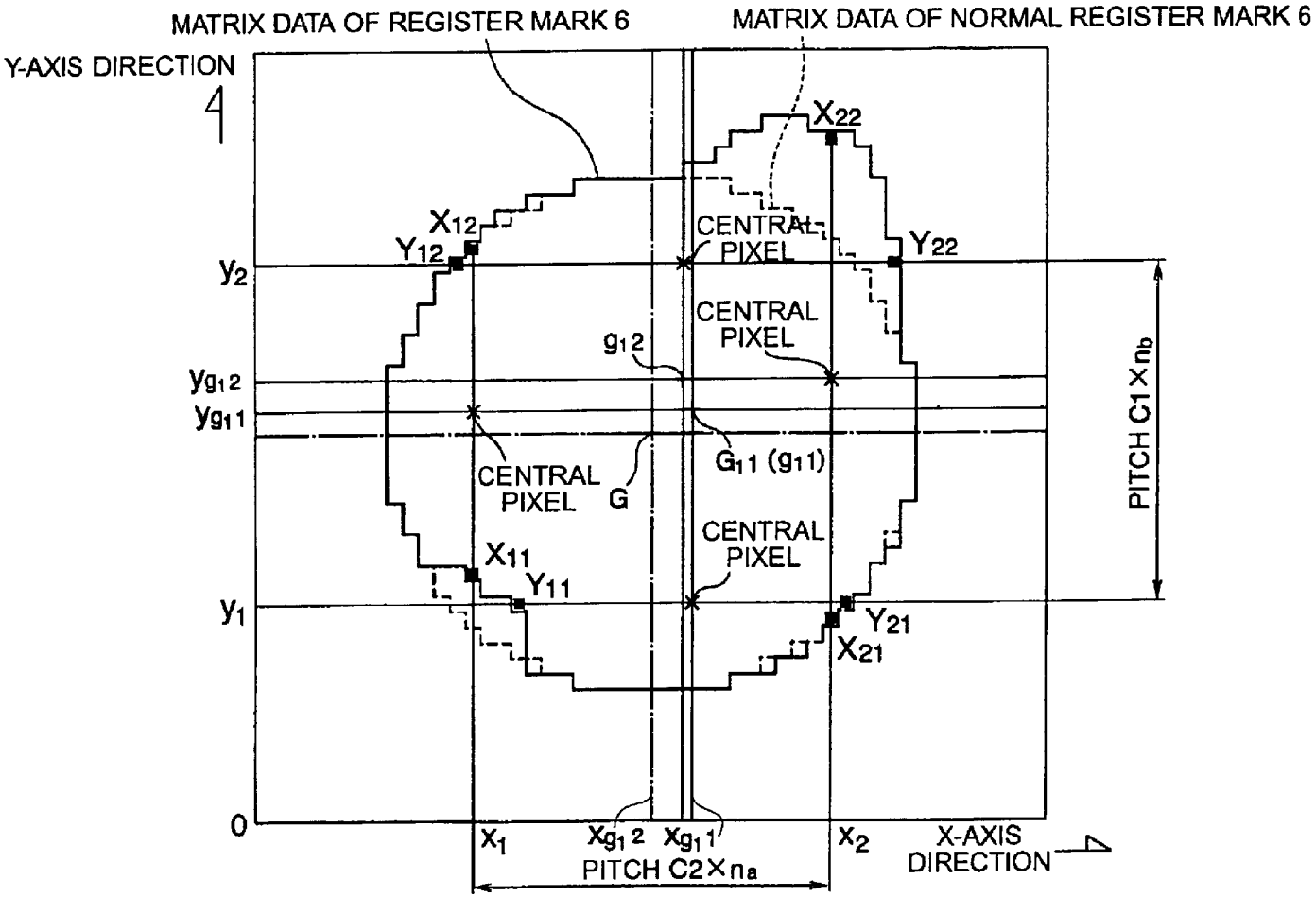
FIG. 6 is a diagram of assistance in explaining a scanning method showing an example where a first center of gravity of a circular register mark is calculated according to the present invention.

FIG. 6 is a diagram of assistance in explaining the method of scanning circular register marks and calculating the first center of gravity thereof according to the present invention. The figure shows the contour of the pixels on the outermost edge of the pixel matrix data of a register mark 6 developed as digitized pixels, with a filled square representing a pixel. For convenience of explanation, pixels are shown slightly coarsely, compared with the size of a register mark 6.

A circular register mark 6, if properly printed and read, would become a matrix data shown by dotted lines in the figure, and its center of gravity would agree with its normal center of gravity G. The matrix data shown in FIG. 6, however, has a projected deformation at the right upper corner, and a missing part at the left lower corner. The center of gravity is therefore located at a position slightly shifted from the normal center of gravity G.

In the calculation procedure ①, the first center of gravity calculating section 34 finds the first center of gravity $G_{11}$ of the matrix data from a plurality of candidate first center of gravity pixels $g_{11}, g_{12}, \ldots g_{1n1}$, then finds the first center of gravity $G_{12}, G_{13}, \ldots G_{1n2}$ of the matrix data of the succeeding register marks 6 that are read at every rotation of the plate cylinder 11, and calculates the moving average of them as the final first center of gravity $G_1$. First, the first center of gravity calculating section 34 reads the matrix data of the register mark 6 from the digitized memory 33, scans the matrix data in parallel with the x-axis starting from the origin 0, and then sequentially repeats the scanning while increasing the y-axis address value in predetermined pitches of $c_1$ until a pixel array is found. When a pixel array is found at a given y-axis address value $y_1$, for example, the first center of gravity calculating section 34 performs a pixel-array validity check to judge whether the pixel array is effective data. If the pixel array is found effective data, the first center of gravity calculating section 34 regards the pixels at both ends of the pixel array as a start pixel $Y_{11}$ $(x_{21}, y_1)$ and an end pixel $Y_{21}$ $(x_{21}, y_1)$, and calculates the length of the pixel array $Y_{11}$ through $Y_{21}(x_{21}-x_{11}+1)$ and the address value of the central pixel of the pixel array $[(x_{11}+x_{21})/2, y_1]$ from the address values of the start and end pixels $Y_{11}$ $(x_{11}, Y_1)$ and $Y_{21}$ $(x_{21}, y_1)$, and stores them in predetermined locations of the internal memory of the first center of gravity calculating section 34.

Figure 9:
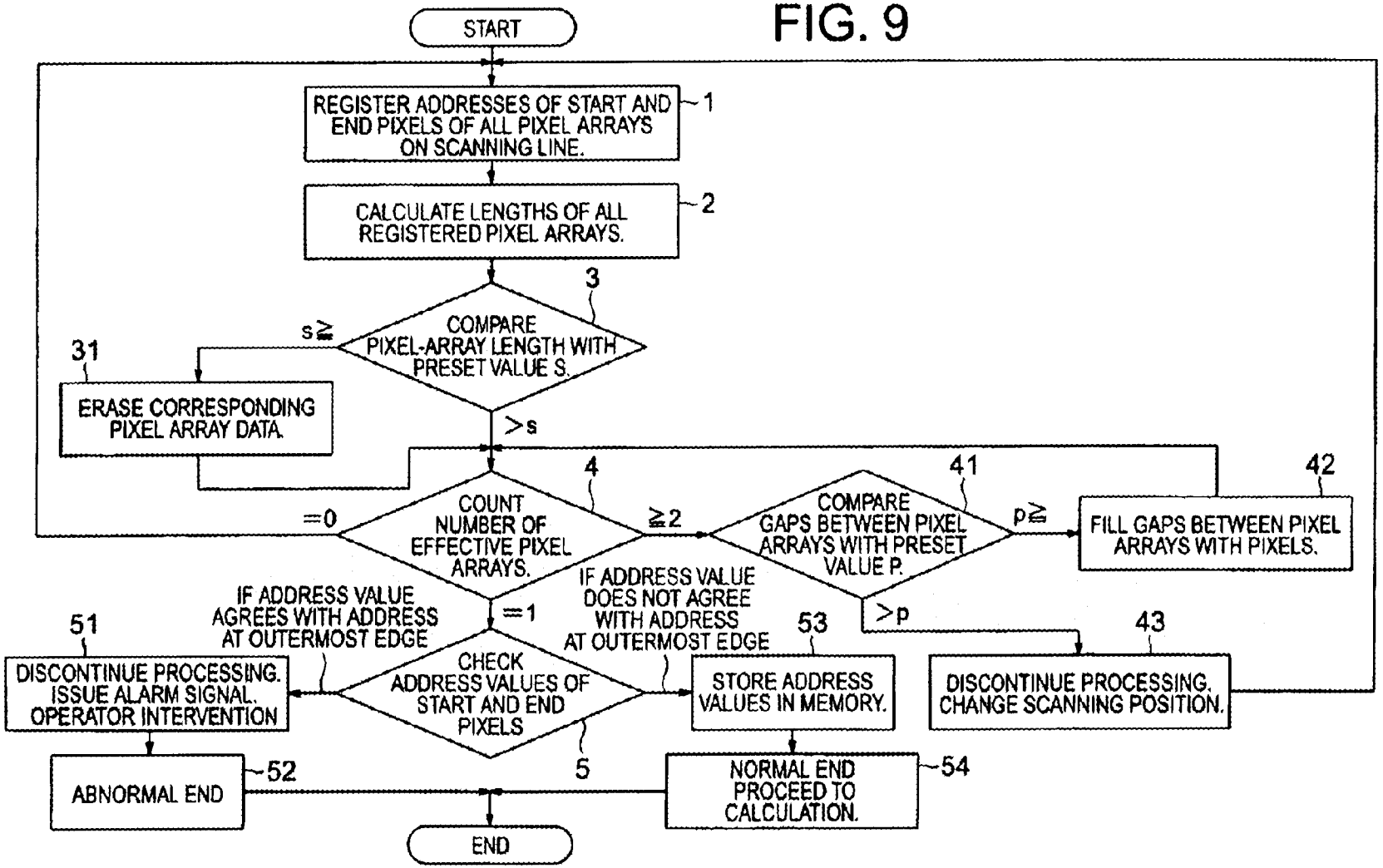
FIG. 9 is a flow chart showing an example of pixel-array validity check.

The procedure of the aforementioned pixel-array validity check will be described, referring to a flow chart of the pixel-array validity check shown in FIG. 9.

First, the first center of gravity calculating section 34 scans the y-axis address values $y_1$, and stores the pairs of the start pixel $Y_{n11}$ $(x_{n11}, y_1)$ and the end pixel $Y_{n21}$ $(x_{21}, y_1)$ of all the pixel arrays on the scanning line in predetermined locations of the internal memory (Step 1). Next, the number of pixels $(x_{n21}-x_{11}+1)$ constituting each pixel array stored in the internal memory is calculated (Step 2), and compared with a predetermined preset value s (Step 3). If the number of pixels constituting the pixel array is less than the preset value s, the pixel array is regarded as a minute contamination and erased from the internal memory 33 (Step 31), so that only those pixel arrays having lengths exceeding the set value a are left in the internal memory, and the number of the pixel arrays left in the internal memory is counted (Step 4).

If the number of the left pixel arrays is more than two, the number of pixels in gaps between the pixel arrays is compared with a predetermined preset value p (Step 41). If the number of gap pixel arrays is less than p, a continuous pixel array is judged as cut into pieces. To cope with this, gaps between the pixel arrays are filled with pixels to make a continuous pixel array (Step 42), then the procedure is returned to Step 4 of counting the number of pixel arrays to repeat the processing. If the number of gap pixels exceeds the preset value p, it is judged that there is no effective data in the y-axis address values, and the processing is suspended (Step 43), and scanning is continued by shifting the scanning line by a pitch $c_1$ in the y-axis direction.

If a single pixel array is eventually left on the scanning line of the y-axis address value $y_1$, the address values of the start pixel $Y_{n11}$ $(x_{n11}, y_1)$ and the end pixel $Y_{n21}$ $(x_{21}, y_1)$ are obtained (Step 5). When these address values agree with the address values of the pixel array at the outermost edge of the matrix data, it is judged that the timing of reading the register marks 6 deviates, or the image of the register mark 6 falls on the outer frame of the CCD element region because contamination extends a wide range in the printing of the register marks 6. In such a case, the processing of the matrix data is suspended and an alarm signal is issued (Step 51). In the example shown in FIG. 9, the operator responds to the alarm signal by intervening the processing for abnormal termination (Step 52). Instead, a light emission timing signal may be automatically output with a time lag to change the reading position until a proper matrix data is input. If the subsequent data still remain abnormal, the processing may be returned to Step 1 through an automatic processing of repeating procedures of waiting the removal of contamination by extending the reading intervals.

If the address values of the start pixel $Y_{11}$ $(x_{n11}, y_1$ and the end pixel $Y_{21}$ $(x_{n21}, y_1)$ do not agree with the pixel-array address values at the outermost edge of the matrix data, this pixel array is regarded as effective data; the start pixel thereof as $Y_{11}$ $(x_{11}, y_1)$ and the end pixel thereof as $Y_{21}$, $(x_{21}, y_1)$, and the address values of the start and end pixels $Y_{11}$, $(x_{11}, y_1)$ and $Y_{21}$ $(x_{21}, y_1)$ are stored in predetermined locations of the internal memory (Step 53). With this, the pixel-array validity check is terminated to proceed to calculation (Step 54). If the register mark 6 is read as a mass of images at a normal timing, a single pixel array is usually found. If no pixel arrays are left in Step 4, scanning is continued by shifting the scanning line by a predetermined pitch in the y-axis direction.

When a single pixel array $Y_{11}$ through $Y_{21}$ at the y-axis address value $y_1$ has been eventually established in the pixel-array validity check, the first center of gravity calculating section 34 calculates the x-axis address value $(x_{11}+x_{21})/2$ of the central pixel of the pixel array, and stores the calculation result in a predetermined location of the internal memory as an x-axis address $x_{g11}$ of a candidate pixel $g_{11}$ of the first center of gravity $G_{11}$ in this matrix data.

If a fraction below decimal point is produced during address value calculation, the result is rounded to the nearest whole number. In this example where the address values of the matrix data are expressed in terms of ten micron meters, this degree of rounding of the address value could maintain enough printing accuracy.

When the x-axis address $x_{g11}$ of the candidate pixel of the first center of gravity $G_{11}$ is found, the first center of gravity calculating section 34 calculates the y-axis address $y_{g11}$ of the candidate pixel $g_{11}$.

First, the matrix data is scanned starting from the origin in parallel with the y-axis, and scanning is repeated by increasing the x-axis address value by a predetermined pitch $c_2$ until a pixel array is found. When a pixel array is found at a given x-axis address value $x_1$, pixel-array validity check is carried out at the x-axis address value $x_1$ in the same procedures as in the case of the pixel-array validity check of the y-axis address value $y_1$ described earlier with reference to FIG. 9. If an effective pixel array is eventually established, the first center of gravity calculating section 34 regards the start pixel of the pixel array as $X_{11}$ ($x_1$, $y_{11}$) and the end pixel thereof as $X_{12}$ ($x_1$, $y_{12}$), calculates the y-axis address value $(y_{11}+y_{12})/2$ of the central pixel of the effective pixel array $X_{11}$, regards the calculation result as the y-axis address $y_{g11}$ of the candidate pixel $g_{11}$ of the first center of gravity $G_{11}$ in this matrix data, and combines the y-axis address $y_{g11}$ with $x_{g11}$ stored in the internal memory earlier for storage into a predetermined location of the internal memory. Consequently, the address of the candidate pixel $g_{11}$ of the first center of gravity $G_{11}$ becomes $$g_{11}\ (x_{g11}, y_{g11})=g_{11}\ [(x_{11}+x_{21})/2,\ (y_{11}+y_{12})/2].$$

The first center of gravity calculating section 34, upon storing the address value of the candidate pixel $g_{11}$ of the first center of gravity $G_{11}$, shifts the address value of the scanning position by a $n_a$ pitch in the x-axis direction and a $n_b$ pitch in the y-axis direction; the number of both pitches being more than one, to perform similar scanning and calculation at different address values $x=x_2$ and $y=y_2$ from those in the previous scanning. The resulting address value of another candidate pixel $g_{12}$ of the first center of gravity $G_{11}$ in the matrix data, $$g_{12}\ (x_{g12}, y_{g12})=g_{12}\ [(x_{12}+x_{22})/2,\ (y_{21}+y_{22})/2]$$

is also stored in a predetermined location of the internal memory of the first center of gravity calculating section 34. In this way, processing is repeated until a preset number $n_1$ of the candidate pixel address values of the first center of gravity $G_{11}$ for a given matrix data are stored in the internal memory.

As $n_1$ pieces of the candidate pixel address values of the first center of gravity $G_{11}$ are stored in the internal memory, the first center of gravity calculating section 34 reads them from the internal memory to find the average address value ($x_{g101}$, $y_{g101}$) of each of the x address values and the y address values, and stores again the results in a predetermined location of the internal memory as the address value of the first center of gravity $G_{11}$ for the matrix data.

Consequently, the address values of the first center of gravity $G_{11}$ of the matrix data are given by Equations (1) and (2).

$$x_{g101}=1/n_1\times(x_{g11}+x_{g12}+\ldots+x_{g1n1})=½n_1\times[(x_{11}+x_{21})+\ldots+(x_{1n1}+x_{2n1})] \quad (1)$$

$$y_{g101}=1/n_1\times(y_{g11}+y_{g12}+\ldots+y_{g1n1})=½n_1\times[(y_{11}+y_{12})+\ldots+(y_{n11}+y_{n12})] \quad (2)$$

If the address value has a fraction below decimal point, the address value is rounded to the nearest whole number. In the example shown in FIG. 6, the first center of gravity $G_{11}$ obtained from the two first-center of gravity candidate pixels $g_{11}$ and $g_{12}$ is found at the location shown in the figure that is deviated from the normal center of gravity G of the register mark 6, and happens to agree with the address value of $g_{11}$. By performing the above calculation procedures, the first center of gravity $G_{11}$ of the matrix data for a given color of a set of register marks 6 can be obtained.

By sequentially performing this processing on register marks 6 for each color, the address values of the first center of gravity $G_{11}$ of all colors for a given set of register marks 6 are stored in predetermined locations of the internal memory of the first center of gravity calculating section 34.

The address value of the first center of gravity $G_{11}$ in a given matrix data can be found quickly by reducing the preset number of processing repetition $n_1$ on the matrix data. If there is enough processing time, or if a higher-speed hardware is used, the address value of the first center of gravity $G_{11}$ can be obtained more accurately by increasing the preset number of processing repetition $n_1$.

Next, the first center of gravity calculating section 34 proceeds to the processing of a next set of register marks 6 that have been consecutively read at every rotation of the plate cylinder 11. First, the first center of gravity calculating section 34 reads the next matrix data of register marks 6 stored in the digitized memory 33, sequentially calculates the address values ($x_{g102}$, $y_{g102}$ of the first center of gravity $G_{12}$ in the matrix data for all colors in the same procedures, and stores them in predetermined locations of the internal memory. This processing is repeated on the matrix data in a set number of reading times $n_2$.

When the first center of gravity address values ($x_{g101}$, $y_{g101}$), . . . ($x_{g1n2}$, $y_{g1n2}$) of the matrix data for the set number of reading times $n_2$ have been stored for all colors in the internal memory, the first center of gravity calculating section 34 calculates the average address value of the x address value and the y address values of the first center of gravity values in the matrix data for each color, regards the calculation result as the address value of the final center of gravity $G_1$ ($x_{g1}$, $y_{g1}$) of each register mark 6, stores it in a predetermined location of the common memory 37 in the register control panel 3, and terminates the calculation procedure ① by outputting a calculation end signal to prepare for the calculation of the address values of the next first center of gravity $G_1$.

Consequently, the address values of the final first center of gravity $G_1$ of each register mark 6 becomes $$x_{g1}=1/n_2\times(x_{g101}+x_{g102}+\ldots+x_{g1n2}) \quad (3)$$

$$y_{g1}=1/n_2\times(y_{g101}+y_{g102}+\ldots+y_{g1n2}) \quad (4).$$

If the address value has a fraction below decimal point, the address value is rounded to the nearest whole number.

The number of matrix data to be process in unit time can be increased by reducing the set number of processing repetition $n_2$ on the matrix data. If there is enough processing time, or if a higher-speed hardware is used, a first center of gravity $G_1$ that is more averaged over time can be obtained by increasing the set number of processing repetition $n_2$.

The final first center of gravity $G_1$ is not shown in FIG. 6 because it is the average center of gravity of one or more matrix data. In the example shown in FIG. 6, scanning is made in the x-axis and y-axis directions, but the scanning direction is not limited to them, but may be any direction as long as it is vertical to the line-symmetrical axis in the point-symmetrical figure. By scanning in that direction and finding in any two directions straight lines passing the central pixel of the obtained pixel-array length and vertical to the scanning direction, the intersection of the lines becomes the first center of gravity $G_{11}$ of the matrix data.

As another example of the calculation procedures carried out by the first center of gravity calculating section 34 based on the geometrical figure rule, the calculation procedure ② applied to the case where a figure containing the first center of gravity $G_1$ on the longest pixel array in the x direction is used as register marks 6 will be described in the following, referring to FIG. 7.

Figure 7:
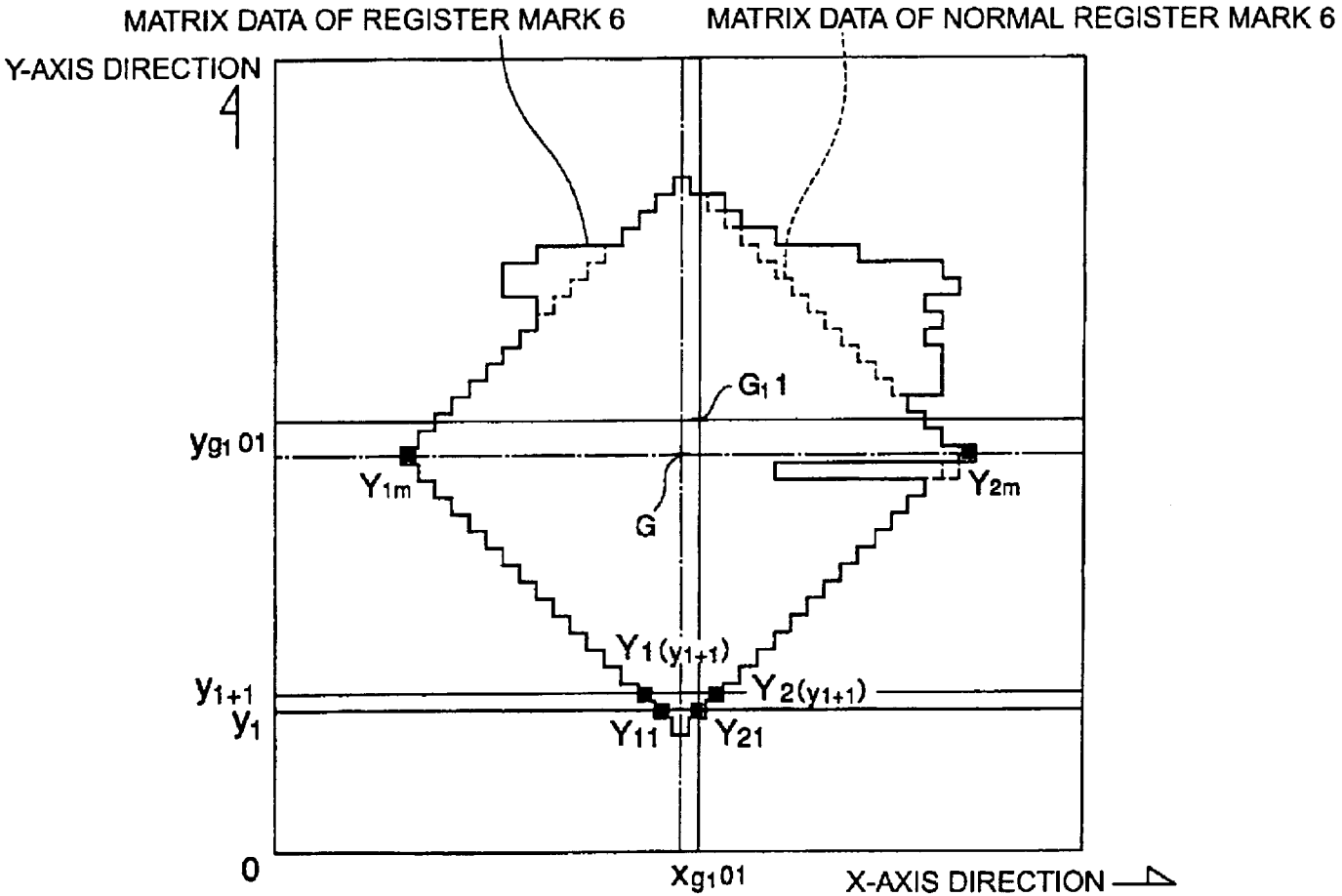
FIG. 7 is a diagram of assistance in explaining a scanning method showing an example where the first center of gravity of a register mark of a 45-degree inclined square shape is calculated according to the present invention.

FIG. 7 is a diagram of assistance in explaining the scanning method in which an example where the first center of gravity of a register mark of a 45-degree inclined square shape is calculated according to the present invention is shown. Shown in the figure is the matrix data obtained by reading a 45-degree inclined square address mark 6 which, if properly printed and read, would have a contour of outer edge pixels shown by dotted lines in the figure, as in the case of the circular register mark 6 described in FIG. 6, and whose center of gravity would agree with the normal center of gravity G. In the case shown in the figure, however, the center of gravity actually deviates from the normal center of gravity due to a deformation that looks like a dragged print mark on the upper half.

In the calculation procedure ②, candidate pixels of the first center of gravity $G_{11}$ for a matrix data are limited by calculation to a single piece of pixel from the beginning. The single candidate pixel is found for a plurality of matrix data read consecutively at every rotation of the plate cylinder 11, and then the final first center of gravity $G_1$ is found by calculating the moving average of these first center of gravity $G_{11}$, $G_{12}$, . . . $G_{1n3}$. First, the first center of gravity calculating section 34 reads the matrix data for a color of the register marks 6 from the digitized memory 33, scans the matrix data from the origin 0 in parallel with the x-axis, and repeats the scanning by increasing the y-axis value one by one until a pixel array is found. In FIG. 7, too, the movement of one pixel is shown coarsely for convenience of explanation. When a pixel array is found at a given y-axis address value, the first center of gravity calculating section 34 performs pixel-array validity check in exactly the same manner as in the case of pixel-array validity check in the calculation procedure ①, as described with reference to FIG. 9. When a single effective pixel array is finally established at the y-axis address value, the start pixel of the pixel array is regarded as $Y_{11}$ ($x_{11}$, $y_1$), and the end pixel thereof as $Y_{21}$ ($x_{21}$, $y_1$), and the pixel-array length ($x_{21}-x_{11}+1$) is made a pair with the y-axis address value $y_1$ and stored in a predetermined location of the internal memory of the first center of gravity calculating section 34. ② Next, the first center of gravity calculating section 34 increases the y-axis address value by one to ($y_1+1$), performs the pixel-array validity check in the same manner, combines the pixel-length ($x_{2(y1+1)}-x_{1(y1+1)}+1$) of the established effective pixel array $Y_1(y_1+1)$ through $Y_2(y_1+1)$ with the y-axis address value ($y_1+1$) as a pair for storage in a predetermined location of the internal memory of the first center of gravity calculating section 34.

The first center of gravity calculating section 34 repeats this processing until it completes the scanning of the entire region of the matrix data, reads and compares the lengths of $n_3$ pieces of all pixel arrays stored in the memory, and regards the longest pixel array among them as $Y_{1m}$ through $Y_{2m}$ for storage in a predetermined location of the internal memory of the first center of gravity calculating section 34. Based on this, the address value of the first center of gravity $G_{11}$ of the matrix data is found following the procedures described below. The calculation procedures will be described in what follows, referring to FIG. 8.

Figure 8:
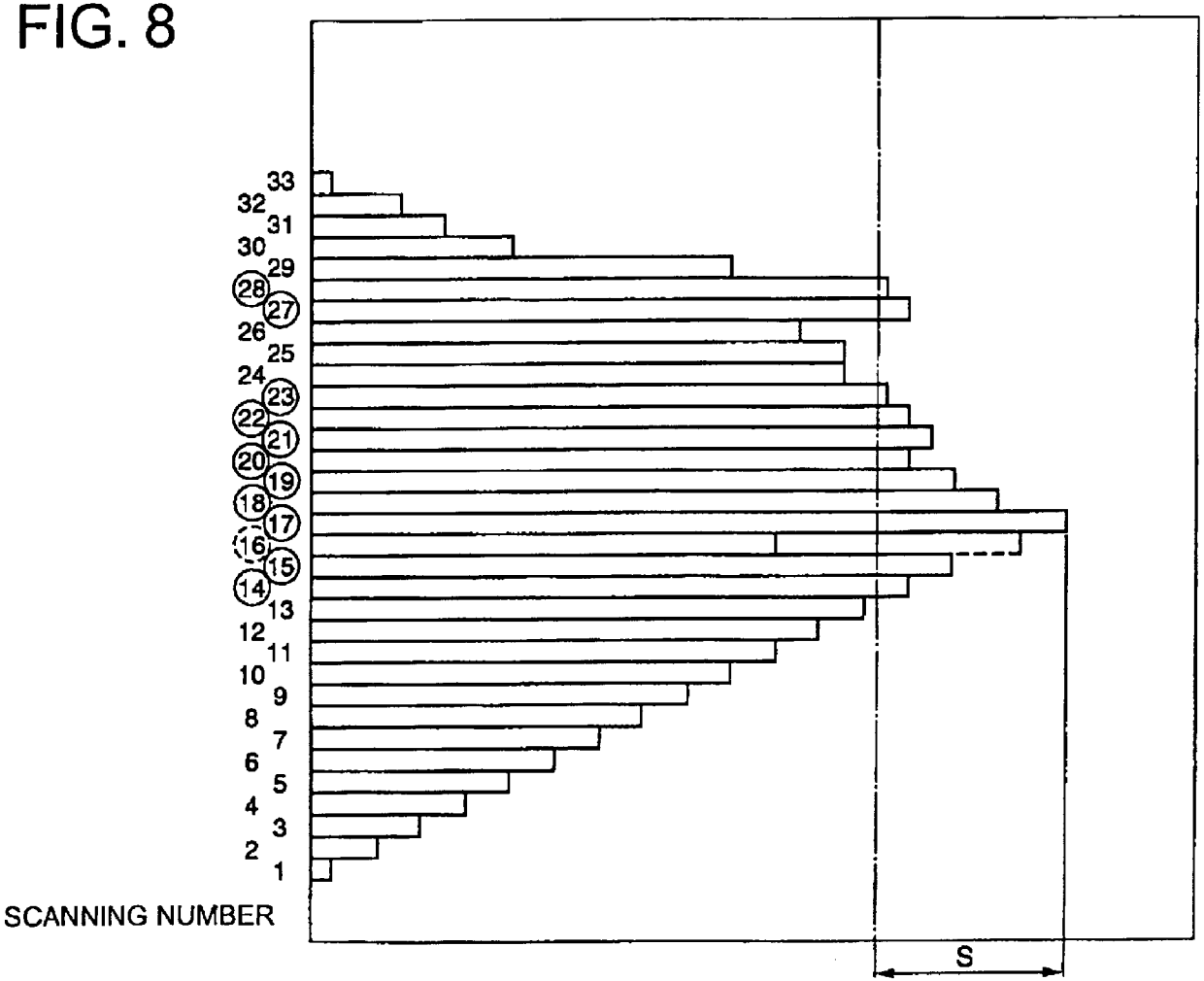
FIG. 8 is a diagram of assistance in explaining a method for extracting pixel arrays.

FIG. 8 is a diagram of assistance in explaining a method for extracting pixel arrays according to the present invention. The figure shows the effective pixel-array length found at each y-axis address value by sequentially scanning the matrix data starting from the origin 0 in parallel with the x-axis following the calculation procedure ②; the effective pixel-array length numbered with serial scanning numbers from 1 through 33 and the start point of the pixel array aligned.

If the register marks are read normally, pixel arrays would be arranged in such a manner that the central part thereof has longest length, with the lengths of the pixel arrays gradually reduced by a predetermined length toward the upper and lower ends. In the example shown, however, the lengths of the pixel arrays in the upper half are uneven, with the No. 17 pixel array having the longest length.

The first center of gravity calculating section 34 extracts all the pixel arrays the difference of whose pixel-array lengths is within a set value s from among the longest pixel arrays $Y_{1m}$ through $Y_{2m}$ that have been obtained in comparison. In the example shown in FIG. 8, eleven pixel arrays having encircled scanning numbers, including the longest pixel array 17 are extracted as the pixel arrays having lengths within a predetermined pixels s.

Next, the continuity of the y-axis address values of the extracted pixel arrays is examined, and gaps of those pixel arrays whose missing address values are within a predetermined pixel number p are filled with the average value of pixels of the pixel arrays on both sides. In the example shown in FIG. 8, a predetermined number of pixels p is assumed to be 1, and the encircled y-axis address values are referred to. Since there is a gap equal to one pixel between the scanning numbers 15 and 17, the length of the array is replaced with the average value of the lengths of the pixel-arrays of the scanning numbers 15 and 17, and the pixel array of the scanning number 16 is also treated as a pixel array whose difference from the longest pixel array is within 8 pixels. In this example, correction is needed only in this place.

Upon completion of the correction of pixel arrays, the first center of gravity calculating section 34 search the extracted pixel arrays for those pixel-array groups having more than a predetermined number k of the y-axis address values arranged continuously. The entire pixel-array groups having continuous y-axis address values are extracted as candidate data. In the example shown in FIG. 8, referring to pixel arrays having encircled scanning numbers by setting k=5 indicates that 10 pixel-array groups having continuous scanning numbers from 14 to 23 meets the requirements for candidate data. Pixel-array groups having scanning numbers 27 and 28 having only two continuous y-axis address values cannot be regarded as candidate data.

If there are multiple candidate data, that is, if there are more than two locations where more than k pieces of pixel arrays whose difference from the longest pixel array is within s are arranged in the y-axis direction, the register marks 6 are judged to have a large deformation. In such a case, the processing of the matrix data is discontinued, and an alarm signal is issued. In the example shown in FIG. 7, there is only one candidate data.

If only one candidate data is found, the first center of gravity calculating section 34 stores the central address of $k_1$ pieces, that is, more than a predetermined number k, of the y-axis address values arranged continuously in predetermined location of the internal memory as the y-axis address value $y_{g101}$ of the first center of gravity $G_{11}$ of the matrix data. In the example shown in FIG. 8, the y-axis address value having the scanning number 19 as the central value of the y-axis address values having the scale numbers 14 through 23 becomes the y-axis address value of the first center of gravity $G_{11}$.

Next, the first center of gravity calculating section 34 finds the central pixel address value of $n_3$ pieces of effective pixel arrays stored in the internal memory, and stores the average address value thereof in a predetermined location of the internal memory as the x-axis address value $x_{g101}$ of the first center of gravity $G_{11}$ in the matrix data. In the example shown in FIG. 8, the central pixel address average value of the pixel arrays having the scanning numbers from 1 through 33 becomes the x-axis address value of the first center of gravity $G_{11}$.

Consequently, the address values of the first center of gravity $G_{11}$ ($x_{g101}$, $y_{g101}$) are expressed by Equations (5) and (6).

$$x_{g101}=\tfrac{1}{2}n_3\times[(x_{11}+x_{21})+\ldots+(x_{1n3}+y_{2n3})] \quad (5)$$

$$y_{g101}=1/k_1\times(y_1+y_2+\ldots+y_{k1}) \quad (6)$$

If the address value has a fraction below decimal point, the address value is rounded to the nearest whole number.

As described above, the calculation procedure ② requires scanning only in the x-axis direction.

In order to increase the number of matrix data to be treated in unit time, only the longest pixel array can be extracted by scanning the entire region of the matrix data and the address value $[(x_{1m}+x_{2m})/2, y_m]$ of the central pixel can be used as the address value of the first center of gravity $G_{11}$ as it is.

By sequentially performing this processing for register marks of each color, the address values of the first center of gravity $G_{11}$ of all colors in a given set of register marks 6 are stored in predetermined locations of the internal memory of the first center of gravity calculating section 34.

Next, the first center of gravity calculating section 34 proceeds to the processing of the next set of register marks 6 read consecutively at each rotation of the plate cylinder 11.

First the first center of gravity calculating section 34 reads the next matrix data of the register marks 6 stored in the digitized memory 33, sequentially calculates the address values ($x_{g102}$, $y_{g102}$) of the first center of gravity $G_{12}$ of all colors in the matrix data in the same procedures, and stores the result in predetermined locations of the internal memory. This processing is repeated for a set number n4 of matrix data.

When the first center of gravity address values ($x_{g101}$, $y_{g101}$), . . . ($x_{g1n4}$, $y_{g1n4}$) of the set number $n_4$ of matrix data are accumulated for all colors in the internal memory, the first center of gravity calculating section 34 calculates the average address values for each color of the x address values and the y address values of the first center of gravity address values in all the matrix data, and stores the results in predetermined locations of the common memory 37 of the register control panel 3 as the address values of the final first center of gravity $G_1$ ($x_{g1}$, $y_{g1}$) of each register mark 6. With this, the first center of gravity calculating section 34 outputs a calculation end signal, and terminates the calculation procedure ② to prepare for the calculation of the address value of the next first center of gravity $G_1$.

Consequently, the address values of the final first center of gravity $G_1$ of each register mark 6 are given by Equations (7) and (8).

$$x_{g1}=1/n_4\times(x_{g101}+x_{g102}+\ldots+x_{g1n4}) \quad (7)$$

$$y_{g1}=1/n_4\times(y_{g101}+y_{g102}+\ldots+y_{g1n4}) \quad (8)$$

If the address value has a fraction below decimal point, the address value is rounded to the nearest whole number.

The number of matrix data to be processed in unit time can be increased by reducing the set number of processing repetition $n_4$ on the matrix data. If there is enough processing time, or if a higher-speed hardware is used, a first center of gravity $G_{11}$ that is more averaged over time can be obtained by increasing the set number of processing repetition $n_4$. The final first center of gravity $G_1$, which is an averaged center of gravity of one or more matrix data, is not shown in FIG. 7.

Aside from the calculation procedures ① and ② described above, a large number of methods for finding the center of gravity of a figure by applying the rule of geometrical figure are publicly known. Incorporating these methods in the calculation procedures of the first center of gravity calculating section 34 and selecting an appropriate one from among them makes it possible to deal with register marks of various shapes.

The location of the first center of gravity $G_1$ that can be obtained by this method tends to deviate from the normal center of gravity G that is an original reference point, as shown in FIGS. 6 and 7, if the register mark 6 is deformed. The first center of gravity $G_1$ of a deformed register mark 6 has low accuracy as a reference point.

Figure 10:
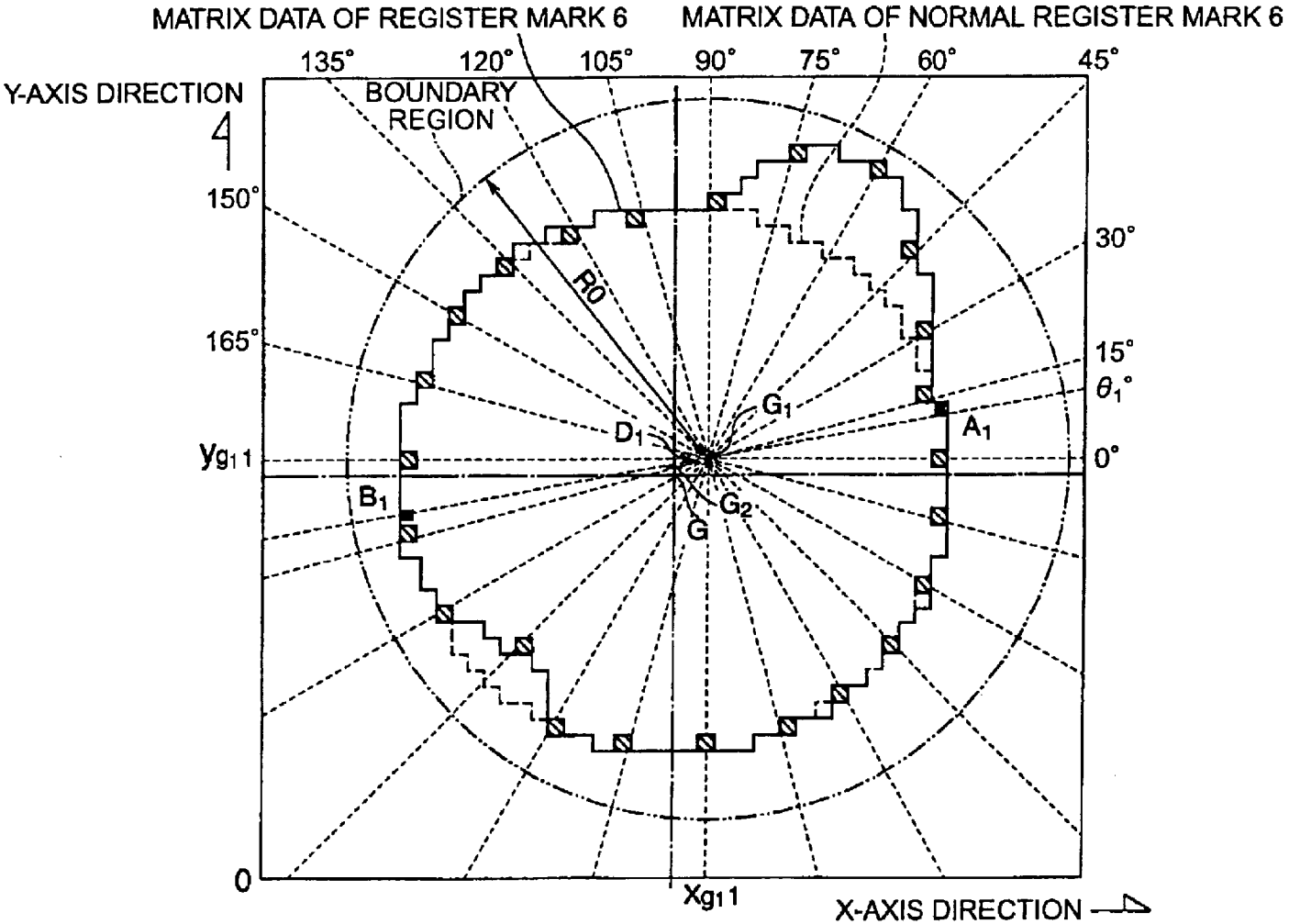
FIG. 10 is a diagram of assistance in explaining matrix data in an example where a second center of gravity of a circular register mark is calculated according to the present invention.

In the present invention, a second center of gravity calculating section 35 for scanning again the matrix data using the first center of gravity $G_1$ as a reference point to bring the reference point closes to the location of the normal center of gravity that is an original reference point. An example where a point-symmetrical figure is used as a register mark 6 as an example of the calculation procedure to be carried out by the second center of gravity calculating section 35 will be described in the following, referring to FIGS. 10 and 11 where a circular register mark 6 and a 45-degree inclined square register mark 6 are used. Aside from these figures, any other point-symmetrical figures, such as a rhombus, rectangle and ellipse, may be used FIG. 10 is a diagram of assistance in explaining a matrix data showing an example where the second center of gravity calculation according to the present invention is performed with a circular register mark. The matrix data shown is the same as the matrix data of the circular register mark used in FIG. 6.

Figure 11:
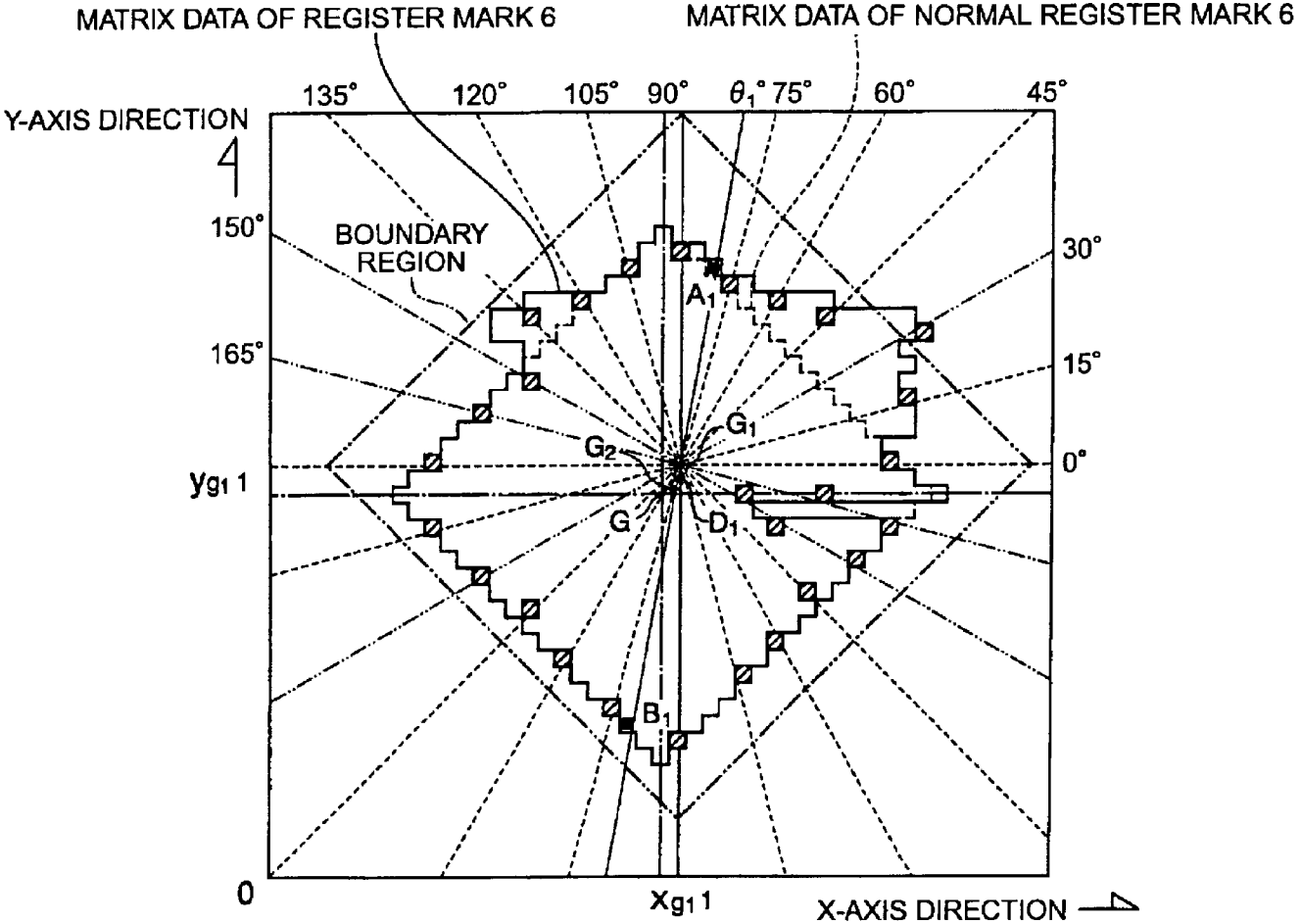
FIG. 11 is a diagram of assistance in explaining matrix data in an example where a second center of gravity of a 45-degree inclined square register mark is calculated according to the present invention.

FIG. 11 is a diagram of assistance in explaining a matrix data showing an example where the second center of gravity calculation according to the present invention is performed with a square register mark. The matrix data shown is the same as the matrix data of the 45-degree inclined square register mark used in FIG. 7.

Both figures show the normal center of gravity G ($x_{g0}$, $y_{g0}$) of a register mark 6 having a geometrically normal shape, and the first center of gravity $G_1$ ($x_{g1}$, $y_{g1}$) calculated by the first center of gravity calculating section 34. The first center of gravity $G_1$, if printed properly, would agree with the normal center of gravity G.

The second center of gravity calculating section 35 finds center of gravity deviation $r\theta_1, \ldots, r\theta_n$ from the first center of gravity $G_1$ as a base point in the radial direction at $\theta_1, \ldots \theta_n$, and calculates the second center of gravity $G_{21}$ from these center of gravity deviations. Furthermore, the second center of gravity calculating section 35 finds the second center of gravity $G_{22}$, $G_{23}$, . . . $G_{2n6}$ from the succeeding matrix data of the register marks 6 read at every rotation of the plate cylinder 11 to calculate the final second center of gravity $G_2$ as the moving average thereof.

Upon receipt of a calculation end signal output from the first center of gravity calculating section 34, the second center of gravity calculating section 35 reads the matrix data for a given color of a set of register marks 6 from the digitized memory 33, reads the address value ($x_{g1}$, $y_{g1}$) of the corresponding first center of gravity $G_1$ to check them, and finds the location of the first center of gravity $G_1$ on the matrix data. If the average value of a plurality of matrix data is taken as the address value of the first center of gravity $G_1$, the matrix data in the digitized memory 33 becomes the final matrix data.

Next, the matrix data is scanned starting from the first center of gravity $G_1$ in the direction of an inclination angle $\theta_1$, and the pixel array found in that angular direction is subjected to a pixel-array validity check, with the scanning direction replaced with the direction of inclination angle $\theta_1$ in exactly the same manner as in the case of the pixel-array validity check at the y-axis address value $y_1$ described with reference to FIG. 9. As a result, two effective pixel arrays each extending in the opposite directions from the first center of gravity $G_1$ are established. Two end pixels of each pixel array are regarded as $A_1$ ($x_{a1}$, $y_{a1}$) and $B_1$ ($x_{b1}$, $y_{b1}$), and the address values thereof are stored in predetermined locations of the internal memory. With this, the second center of gravity calculating section 35 terminates the pixel-array validity check and proceeds to the next calculation.

In the example shown in FIG. 11, the pixel array is discontinued between 150 degrees and 165 degrees, resulting in a plurality of pixel arrays on a single scanning line. The data in this angular direction becomes invalid in the process of pixel-array validity check.

In the process of calculation, the second center of gravity calculating section 35 reads the address values of the two pixel-array end pixels $A_1$ and $B_1$, calculates the length of the pixel array using the following equations, and stores the calculation results in predetermined locations of the internal memory.

$$\text{Length of pixel array } G_1 \text{ through } A_1 = |x_{a1} - x_{g1}|/\cos\theta_1| \quad (9)$$

$$\text{Length of pixel array } G_1 \text{ through } B_1 = |x_{b1} - x_{g1}|/\cos(180+\theta_1)| \quad (10)$$

When a printed register mark 6 is deformed remarkably or contaminated heavily, the length of pixel arrays found in the direction of deformation or contamination may take a large value. The second center of gravity calculating section 35 sets a boundary region that is obtained by enlarging the shape of a normal register mark at a given scale factor, with the first center of gravity $G_1$ as the reference point. If an end of a pixel array runs out of the boundary region, the second center of gravity calculating section 35 regards the two pixel array data $G_1$ through $A_2$ and $G_1$ through $B_2$ at the inclination angle of $\theta_n$ as invalid data and does not store in the internal memory, and proceeds to the calculation at another inclination angle. In this example, the boundary region is set to 1.3 times as large as the outer shape of a normal register mark.

In the example shown in FIG. 10 where the boundary region is set as a circle having a radius $R_0$ (1.3 times the radius of a register mark) with the first center of gravity $G_1$ being the center thereof, there is no pixel array running out of the boundary region.

In the example shown in FIG. 11 where the boundary regions is set as a square having side-lengths 1.3 time as large as those of a register mark with the first center of gravity $G_1$ being the center thereof, a pixel array in the direction of 30 degrees runs out of the boundary region, making the data in this angular direction invalid.

The difference between the two pixel-array lengths found from Equation (9) and (10) is a value proportional to the amount of deviation of the first center of gravity $G_1$ from the normal center of gravity G, appearing remarkably in the direction in which the first center of gravity $G_1$ deviates from the normal center of gravity G.

The second center of gravity calculating section 35 reads two pixel-array lengths from the internal memory, calculates the difference $k\theta_1$ of the two pixel-array lengths from Equation (11), and then half of the difference obtained by multiplying the difference of the two pixel-array lengths by ½ using Equation (12), regards the result as the center of gravity deviation-$\theta_1$ in the direction of the inclination angle $\theta_1$, combines the three values of $\theta_1$, $k\theta_1$ and $r\theta_1$ into a set, and stores the set in a predetermined location of the internal memory of the second center of gravity calculating section 35.

$$k\theta_1 = |x_{a1} - x_{g1}|/\cos\theta_1| - |x_{b1} - x_{g1}|/\cos(180+\theta_1)| \quad (11)$$

$$r\theta_1 = ½ \times k\theta_1 \quad (12)$$

Next, the second center of gravity calculating section 35 causes the scanning inclination angle $\theta_1$ to change from $\theta_1$ to $\theta_n$ to find the k values $k\theta_1$, . . . $k\theta_n$ at n pieces of inclination angles and center of gravity deviations $r\theta_1$, . . . $r\theta_n$, combines the three values into a set, and stores n sets of the three values in predetermined locations of the internal memory, as in the case of $\theta_1$ degrees. In the examples of FIGS. 10 and 11, the entire circumference is scanned in increments of 15 degrees.

If the register mark 6 is deformed remarkably over a wide range, the pixel-array length found by Equations (9) and (10) may exceed the set value in the process of finding the center of gravity deviation $r\theta_n$ by causing the inclination angle $\theta_n$, increasing the range of inclination angles in which the data become invalid. When the pixel-array length becomes invalid around the first center of gravity $G_1$, with the result that the range of inclination angles in which the center of gravity deviation $r\theta_n$ cannot be found exceeds a predetermined opening angle $\alpha$, the second center of gravity calculating section 35 judges that it is impossible to find the second center of gravity $G_2$ for the matrix data, suspends the calculation procedure for that matrix data, and fetches the next first center of gravity address value and the corresponding matrix data.

The second center of gravity calculating section 35, upon completion of the calculation of center of gravity deviations at n pieces of inclination angles, reads the center of gravity deviations stored in the internal memory, compares them to find the maximum value, combines the resulting maximum center of gravity deviation $r\theta_m$, the corresponding k value $k\theta_m$ and the inclination angle $\theta_m$ into a set, and stores the set in a predetermined location of the internal memory of the second center of gravity calculating section 35.

Now assume that the pixels at both ends of a pixel array in the direction of inclination angle $\theta_m$ are $A_m$ ($x_{am}$, $y_{am}$) and $B_m$ ($x_{bm}$, $y_{bm}$), and that the center of gravity is shifted in the direction of a shorter pixel array among the two pixel arrays $G_1$ though $A_m$ and $G_1$ through $B_m$. Then, the deviation can be corrected by finding a center of gravity deviation correcting pixel in the direction of a longer pixel array on the opposite side. Consequently, the pixel that is away from $G_1$ by the center of gravity $r\theta_1$ obtained by Equation (12) on the longer pixel array is regarded as a center of gravity deviation correcting point $D_1$.

Since the $k\theta_m$ stored in the internal memory is the difference between the pixel arrays $G_1$ through $A_m$ and $G_1$ through $B_m$, the second center of gravity calculating section 35 refers to $k\theta_m$ at the inclination angle of $\theta_m$ read from the internal memory, judges that if the $k\theta_m$ value is positive, the pixel array $G_1$ through $A_m$ is longer, and if it is negative, the pixel array $G_1$ through $B_m$ is longer, finds a pixel that is away from the first center of gravity $G_1$ by $r\theta_m$ on a longer pixel array, and regards the result as the maximum center of gravity deviation correcting point $D_m$ ($x_m$, $y_m$).

That is, the location obtained by adding $r\theta_m$ to the address value, both negative and positive, of the first center of gravity $G_1$ is the address value of the maximum center of gravity deviation correcting point $D_m$.

The second center of gravity calculating section 35 calculates the address value using Equations (13) and (14) and stores it in a predetermined location of the internal memory.

$$x_m = r\theta_m \times |\cos\theta_m| + x_{g1} \tag{13}$$

$$y_m = r\theta_m \times |\sin\theta_m| + y_{g1} \tag{14}$$

If the address value has a fraction below decimal point, the address value is rounded to the nearest whole number. In this example where the address values of the matrix data are expressed in terms of ten micron meters, this degree of rounding of the address value to ten micron meters could maintain enough printing accuracy.

Since the inclination angle of a maximum center of gravity deviation obtained by scanning a plurality of inclination angles selected arbitrarily or in increments of a given angle hardly agrees completely with the actual center of gravity deviation inclination angle of the matrix data, the obtained maximum center of gravity deviation $r\theta_m$ is very close to, but does not always agree with the actual center of gravity deviation. Furthermore, if the outer edge of the matrix data is locally deformed, the maximum center of gravity deviation $r\theta_m$ may become a salient value, producing a difference in address values between the maximum center of gravity deviation correcting point $D_m$ and the second center of gravity $G_2$ to be found as a reference.

Consequently, the second center of gravity calculating section 35, upon finding the maximum center of gravity deviation $r\theta_m$, reads a preset number (2ns+1) of the maximum center of gravity deviation $r\theta_m - n_6, \ldots r\theta_m, \ldots r\theta_m + n_5$ before and after this inclination angle from the memory, and calculates the average values of them, regarding the average values as the address values of the second center of gravity $G_2$. Thus, the address values of the second center of gravity $G_2$ are expressed by Equations (15) and (16) below.

$$x_{g201} = 1/(2n_5+1) \times (r\theta_m - n_5 \times |\cos\theta_{m-n5}| + \ldots + r\theta_m \times |\cos\theta_m| + \ldots + r\theta_{m+n5} \times |\cos\theta_{m+n5}| + x_{g1} \tag{15}$$

$$y_{g201} = 1/(2n_5+1) \times (r\theta_{m-n5} \times |\sin\theta_{m-n5}| + \ldots + r\theta_m \times |\sin\theta_m| + \ldots + r\theta_{m+n5} \times |\sin\theta_{m+n5}| + y_{g1} \tag{16}$$

If the address value has a fraction below decimal point, the address value is rounded to the nearest whole number. The obtained address values of the second center of gravity $G_2$ in this matrix data are stored again in predetermined locations of the internal memory.

In order to quickly find the address values of the second center of gravity $G_2$ in a matrix data, the maximum center of gravity deviation correcting point $D_m$ ($x_m$, $y_m$) found from the maximum center of gravity deviation $r\theta_m$ may be used as the second center of gravity $G_2$ as it is. If there is enough processing time, or if a higher-speed hardware is used, the address values of the second center of gravity $G_2$ can be obtained more accurately by increasing the direction of the inclination angle for averaging calculation.

In the example shown in FIG. 10, the maximum center of gravity deviation angle becomes 15 degrees, and the second center of gravity $G_2$ is shown as the average address value obtained by adding to it the center of gravity deviation for the adjoining angles 0 degrees and 30 degrees.

In the example shown in FIG. 11, the maximum center of gravity deviation angle becomes 75 degrees, and the second center of gravity $G_2$ is shown as the average address value obtained by adding to it the center of gravity deviation for the adjoining angles 60 degrees and 90 degrees. In both cases, the second center of gravity $G_2$ is found at a location nearer to the normal center of gravity than the first center of gravity $G_1$, indicating that the effects of the deformation of the register mark 6 is reduced.

Next, the second center of gravity calculating section 35 reads the address value of the first center of gravity $G_1$ for the next color and the corresponding digitized matrix data from the common memory $^{37}$, calculates the address value ($x_{g21}$, $y_{g21}$) of the second center of gravity $G_2$ in this matrix data in the same procedures, calculates the second center of gravity $G_2$ for all colors by repeating this process, and stores them in predetermined locations of the internal memory. This processing is repeated for a preset pieces n6 of matrix data. As the address values ($x_{g201}$, $y_{g201}$), . . . ($x_{g2n6}$, $y_{g2n6}$) of the second center of gravity $G_2$ for a preset pieces $n_6$ of matrix data for each register mark 6 are accumulated in the internal memory of the second center of gravity calculating section 35, the second center of gravity calculating section 35 calculates the average address value ($x_{g2}$, $y_{g2}$) of each second center of gravity $G_2$. If the address value has a fraction below decimal point, the address value is rounded to the nearest whole number, and stored in a predetermined location of the common memory 37 as the address value of the second center of gravity $G_2$ of each register mark 6. With this, the second center of gravity calculating section 35 outputs a calculation end signal, terminates the calculation and prepares for the calculation of the next address value of the second center of gravity G2.

By setting the preset number ns to a smaller number, processing can be performed in a short period of time, and by setting the preset number $n_6$ to a larger number, an address value of the second center of gravity $G_2$ that is more averaged over time can be obtained.

Since the first center of gravity calculating section 34 has a multiple calculation function incorporating a plurality of calculation procedures, the calculation of finding the second center of gravity $G_2$ can be performed by the first center of gravity calculating section 34 by appropriately programming the processing of the second center of gravity calculating section 35 and incorporating it in the first center of gravity calculating section 34.

The deviation calculating means 36, upon receipt of a calculation end signal from the second center of gravity calculating section 35, reads a set of the address values for four colors of the second center of gravity $G_2$ stored in the predetermined locations of the common memory 37, regards the address value of the second center of gravity $G_2$ of a predetermined color as a reference, calculates the length of the pixel array up to the address values of the second center of gravity $G_2$ of the other colors from the reference address value and information on the positional relationship of the matrix data read as divided subregions, and compares the obtained pixel-array length with the length of the pixel arrays up to the address values of the second center of gravity $G_2$ for the other colors to obtain the deviation. In the example shown in FIG. 2 where the right-hand plate cylinder for black is used as a reference plate cylinder 13, the register mark 6 for black is used as a reference and the deviation of the address value of the second center of gravity of the register marks 6 for the other colors from the address value of the second center of gravity $G_2$ for black is calculated.

The deviation calculating means 36 stores the calculated deviation value in a predetermined location of the common memory 37, terminates the calculation by outputting a calculation end signal, and prepares for the calculation of the next deviation.

Upon receipt of a calculation end signal from the deviation calculating means 36, the control signal output section 7 reads the deviation value from the common memory 37, converts the deviation value into a phase control signal that can be used to drive the motor in the motor drive 81 of the plate cylinder phase control means 8 and transmits the signal to the plate cylinder phase control means 8.

The inputting and outputting of these calculation procedures and calculation results may be processed and controlled exclusively by a microprocessor.

In the plate cylinder phase control means 8, the motor drive 81 uses the phase of the reference plate cylinder 13 as a reference to control the phase of the other plate cylinders by causing the longitudinal-direction control motor 15 and the lateral-direction control motor 16 to rotate based on the received phase control signal. Description of this technique is omitted here because it is publicly known and has no direction relations with the present invention.

As described above, the present invention makes it possible to prevent excessive registering errors even when register marks are not printed properly due to unstable printing conditions, thereby reducing the generation of spoilage since even if deformed register marks are printed, the center of gravity locations of the deformed register marks can be properly detected and set.

The present invention has great beneficial effects in resources saving, energy conservation and skill saving because it can reduce the time required to maintain registration particularly at the start of printing.

Furthermore, any shapes of register marks can be used as long as such shapes are point-symmetrical. The calculation section according to the present invention has great versatility because of its multiple calculation function.

What is claimed is:

1. A method for detecting registering errors for multicolor rotary presses which comprises steps of printing one or more register marks on a paper web in each printing section, causing a light source to flash based on a reference signal output by signal output means that operates in synchronism with the rotation of a predetermined reference plate cylinder and issues signals, causing reading means that operates in synchronism with the flashing of the light source to read the register marks printed by all the printing sections, developing the register marks into matrix data, and finding a first center of gravity from the matrix data as an approximate center of gravity of each register mark, using the first center of gravity as a basis point to find a second center of gravity as a high-precision center of gravity of each register mark, using the second center of gravity of a predetermined register mark as a reference to find the relative position of the second center of gravity of any other register mark, finding deviations of the found relative positions from a predetermined reference relative position, and regarding the deviation as a registering error.

2. A method for detecting registering errors for multicolor rotary presses as set forth in claim 1 wherein a process of reading the register marks printed by all the plate cylinders, developing the read register marks into matrix data, and finding a first center of gravity of each register mark from the matrix data is repeated a predetermined number of times, and the average coordinate value of the predetermined number of first center of gravity as the final first center of gravity coordinate value.

3. A method for detecting registering errors for multicolor rotary presses as set forth in claim 2, wherein the register marks are of a single and point- symmetrical figure, a first center of gravity of each register mark is found as an approximate center of gravity thereof from the matrix data prepared by developing the read register marks, and a second center of gravity is found as a high-precision center of gravity from the first center of gravity.

4. A method for detecting registering errors for multicolor rotary presses as set forth in claim 2, wherein the register marks are of a single and point- symmetrical figure having at least two lines of symmetry, two virtual x-y coordinate systems having the two axial symmetry lines of the register marks as the y-axis are set, the matrix data is scanned for each virtual x-y coordinate system in increments of a predetermined pitch along the y axis in the direction vertical to the y axis, lines parallel to the y-axis and having as the x coordinate value the x coordinate average value of the length centers between the resulting matrix-data outer edge length centers are found, and the intersection of the two straight lines is regarded as a first center of gravity.

5. A method for detecting registering errors for multicolor rotary presses as set forth in claim 1, wherein the register marks are of a single and point-symmetrical figure, a first center of gravity of each register mark is found as an approximate center of gravity thereof from the matrix data prepared by developing the read register marks, and a second center of gravity is found as a high-precision center of gravity from the first center of gravity.

6. A method for detecting registering errors for multicolor rotary presses as set forth in claim 5, wherein a line segment produced when the straight line passing the first center of gravity intersects with the outer edge of the matrix data at two points is divided by the first center of gravity into two line segments, the length half the difference in length between the two line segments is regarded as a center of gravity deviation, a point on a longer line segment among the two line segments separated from the first center of gravity by a length equal to the center of gravity deviation is regarded as a center of gravity deviation point, find the center of gravity deviation point in a plurality of directions, and the center of gravity deviation point that is remotest from the first center of gravity among the resulting center of gravity deviation points is regarded as a second center of gravity.

7. A method for detecting registering errors for multicolor rotary presses as set forth in claim 6, wherein the average coordinate value of the center of gravity points is regarded as a second center of gravity coordinate value.

8. A method for detecting registering errors for multicolor rotary presses as set forth in claim 1, wherein the register marks are of a single and point-symmetrical figure having at least two lines of symmetry, two virtual x-y coordinate systems having the two axial symmetry lines of the register marks as the y-axis are set, the matrix data is scanned for each virtual x-y coordinate system in increments of a predetermined pitch along the y axis in the direction vertical to the y axis, lines parallel to the y-axis and having as the x coordinate value the x coordinate average value of the length centers between the resulting matrix-data outer edge length centers are found, and the intersection of the two straight lines is regarded as a first center of gravity.

9. A method for detecting registering errors for multi-color rotary presses as set forth in claim 8, wherein a line segment produced when the straight line passing the first center of gravity intersects with the outer edge of the matrix data at two points is divided by the first center of gravity into two line segments, the length half the difference in length between the two line segments is regarded as a center of gravity deviation, a point on a longer line segment among the two line segments separated from the first center of gravity by a length equal to the center of gravity deviation is regarded as a center of gravity deviation point, find the center of gravity deviation point in a plurality of directions, and the center of gravity deviation point that is remotest from the first center of gravity among the resulting center of gravity deviation points is regarded as a second center of gravity.

10. An apparatus for detecting registering errors for multi-color rotary presses comprising signal output means operating in synchronism with the rotation of a predetermined plate cylinder for outputting a reference signal, a sensor for detecting the reference position of the rotating reference plate cylinder to output a reference position signal, a light source provided in the vicinity of a paper web for illuminating a plurality of register marks printed on the paper web by separate printing section, a light emission timing section for outputting a light emission timing signal based on the reference signal and the reference position signal, reading means provided facing the traveling paper web for reading the register marks to fetch as two-dimensional image data, an image data processing section for digitizing the two-dimensional image data into pixel matrix data for storage into a memory, a first center of gravity calculating section for finding a first center of gravity as an appropriate center of gravity from the matrix data of each register mark, a second center of gravity for finding a second center of gravity as a high-precision center of gravity based on the first center of gravity from the matrix data of each register mark, and deviation calculating means for using as a reference the second center of gravity of a predetermined register mark to find the relative positions of other register marks, and finding a deviation of the obtained relative positions from a predetermined reference position.

11. An apparatus for detecting registering errors for multi-color rotary presses as set forth in claim 10, wherein the first center of gravity calculating section and the second center of gravity calculating section are combined into a single calculating section.

12. An automatic register control apparatus for multi-color rotary presses comprising signal output means operating in synchronism with the rotation of a predetermined plate cylinder for outputting a reference signal, a sensor for detecting the reference position of the rotating reference plate cylinder to output a reference position signal, a light source provided m the vicinity of a paper web for illuminating a plurality of register marks printed on the paper web by separate printing section, a light emission timing section for outputting a light emission timing signal based on the reference signal and the reference position signal, reading means provided facing the traveling paper web for reading the register marks to fetch as two-dimensional image data, an image data processing section for digitizing the two-dimensional image data into pixel matrix data for storage into a memory, a first center of gravity calculating section for finding a first center of gravity as an appropriate center of gravity from the matrix data of each register mark, a second center of gravity for finding a second center of gravity as a high-precision center of gravity based on the first center of gravity from the matrix data of each register mark, deviation calculating means for using as a reference the second center of gravity of a predetermined register mark to find the relative positions of other register marks, and finding a deviation of the obtained relative positions from a predetermined reference position, a control signal output section for converting the resulting deviation value into a plate cylinder phase control signal, and plate cylinder phase control means for controlling plate cylinder phase based on the phase control signal.

13. An automatic register control apparatus for multi-color rotary presses as set forth in claim 12, wherein the first center of gravity calculating section and the second center of gravity calculating section are combined into a single calculating section.

* * * * *